US011767582B2

(12) United States Patent
Inoue et al.

(10) Patent No.: US 11,767,582 B2
(45) Date of Patent: Sep. 26, 2023

(54) STEEL MATERIAL EXHIBITING HIGH TOUGHNESS, METHOD FOR MANUFACTURING THE SAME, AND STRUCTURAL STEEL PLATE FABRICATED USING STEEL MATERIAL

(71) Applicant: NATIONAL INSTITUTE FOR MATERIALS SCIENCE, Ibaraki (JP)

(72) Inventors: Tadanobu Inoue, Ibaraki (JP); Hai Qiu, Ibaraki (JP); Rintaro Ueji, Ibaraki (JP)

(73) Assignee: NATIONAL INSTITUTE FOR MATERIALS SCIENCE, Ibaraki (JP)

( * ) Notice: Subject to any disclaimer, the term of this patent is extended or adjusted under 35 U.S.C. 154(b) by 800 days.

(21) Appl. No.: 16/760,950

(22) PCT Filed: Nov. 8, 2018

(86) PCT No.: PCT/JP2018/041416

§ 371 (c)(1),
(2) Date: May 1, 2020

(87) PCT Pub. No.: WO2019/093399

PCT Pub. Date: May 16, 2019

(65) Prior Publication Data

US 2023/0057152 A1 Feb. 23, 2023

(30) Foreign Application Priority Data

Nov. 10, 2017 (JP) ..... 2017-217475
Mar. 22, 2018 (JP) ..... 2018-054620

(51) Int. Cl.
*C22C 38/04* (2006.01)
*C21D 8/02* (2006.01)
(Continued)

(52) U.S. Cl.
CPC ..... *C22C 38/04* (2013.01); *C21D 8/0205* (2013.01); *C21D 8/0221* (2013.01); *C21D 9/46* (2013.01);
(Continued)

(58) Field of Classification Search
None
See application file for complete search history.

(56) References Cited

U.S. PATENT DOCUMENTS

2010/0047617 A1* 2/2010 Sugiura ..... C23C 2/40
420/104

FOREIGN PATENT DOCUMENTS

EP 2 088 218 8/2009
JP 04147915 A * 5/1992
(Continued)

OTHER PUBLICATIONS

International Search Report (ISR) dated Feb. 12, 2019 in International (PCT) Application No. PCT/JP2018/041416.
(Continued)

*Primary Examiner* — Anthony M Liang
(74) *Attorney, Agent, or Firm* — Wenderoth, Lind & Ponack, L.L.P.

(57) ABSTRACT

The present invention provides a steel material which has a plate shape and achieves both high strength and high rigidity by imparting large nonuniform deformation to the steel material utilizing rolling using a large-diameter work roll. The steel plate according to an embodiment of the present invention is produced by performing rolling using a rolling mill having a work roll diameter of 650 mm or more in a warm temperature region so that a nonuniform metallographic structure is formed in a plate thickness direction and thus the steel plate of the present invention is a high-strength and high-rigidity steel plate in which a yield strength is 580
(Continued)

MPa or more and a Young's modulus at a plate thickness center portion or a surface layer portion is 210 GPa or more and a difference in Young's moduli at the plate thickness center portion and the surface layer portion is 5 GPa or more in a case in which a tensile direction in a tensile test is at least any one of a rolling direction, a plate width direction, or a direction forming an angle difference of 45 degrees from the rolling direction and the plate width direction.

12 Claims, 12 Drawing Sheets

(51) Int. Cl.

| | |
|---|---|
| ***C22C 38/02*** | (2006.01) |
| ***C22C 38/06*** | (2006.01) |
| ***C21D 9/46*** | (2006.01) |

(52) U.S. Cl.
CPC ..... *C22C 38/02* (2013.01); *C22C 38/06* (2013.01); *C21D 2201/00* (2013.01)

(56) References Cited

FOREIGN PATENT DOCUMENTS

| | | |
|---|---|---|
| JP | 2009-249698 | 10/2009 |
| JP | 2012-26040 | 2/2012 |
| JP | 2017-125229 | 7/2017 |

OTHER PUBLICATIONS

Tadanobu INOUE, "Strain variations on rolling condition in accumulative roll-bonding by finite element analysis", "Finite Element Analysis" Chapter 24, pp. 589-610, 2010, https://www.intechopen.com/books/finite-element-analysis, cited in the specification.
Notice of Reasons for Refusal dated Feb. 16, 2021 in corresponding Japanese Patent Application No. 2019-552364, with English translation.
Communication pursuant to Article 94(3) EPC dated Jan. 20, 2022 in corresponding European Patent Application No.
Extended European Search Report dated Jun. 23, 2021 in corresponding European Patent Application No. 18876391.6.

* cited by examiner

AGS: average grain size

STEEL MATERIAL EXHIBITING HIGH TOUGHNESS, METHOD FOR MANUFACTURING THE SAME, AND STRUCTURAL STEEL PLATE FABRICATED USING STEEL MATERIAL

TECHNICAL FIELD

The present invention relates to a steel material for structural material, which is desired to exhibit both high strength and high rigidity and a method for manufacturing the same.

BACKGROUND ART

Sheet steel for automobile structure are desired to exhibit high strength capable of withstanding impact such as a collision accident and workability capable of being subjected to plastic working by press molding and the like. Hence, various measures for achieving both high strength and high ductility have been proposed. However, it is necessary to increase the resistance force with respect to elastic deformation in order to secure the firm rigidity of vehicle body, and various means have been so far devised. The most typical means is to disperse particles having a higher elastic constant in the steel plate and to adjust the crystal orientation so-called texture by working and heat treatment.

Patent Literature 1 discloses a technology that utilizes the dispersion of boride particles which contains titanium and has a high elastic constant. However, the utilization of dispersed particles used in this technology has problems such as an increase in manufacturing cost and the stable procurement of raw materials to be added for production of the dispersed particles. Hence, a new method for increasing strength and rigidity is desired in which additional elements other than the constituent elements of steel material are not needed at all.

In the technology disclosed in Patent Literature 2, it is possible to control the texture and obtain a steel plate having a high Young's modulus in a direction to be 30° to 75° with respect to the rolling direction by increasing the Al content, utilizing MnS, and devising the rolling conditions and heat treatment conditions. It is known that the Young's modulus of steel greatly changes as illustrated in FIG. 1 depending on the crystal orientation of the load axis. Hence, by adjusting the crystal orientation, the elastic constant in a particular direction can be increased but there is a problem that the strength decreases at the time of the heat treatment. Moreover, there is also a problem that the toughness decreases by the addition of Al.

In addition, a steel plate is a kind of shaped material and is plastically worked into a shape corresponding to the product by secondary working such as press molding. In general, plastic working of secondary working often involves tensile deformation, and a problem arises in the moldability and delayed fracture property at the tensile deformation portion as the strength of steel plate increases.

As one method for preventing defects such as breakage due to tensile deformation, there is a method in which residual compressive stress is imparted to the steel plate. As a method therefor, control of residual stress by shot peening is known. In Patent Literature 3, it is attempted to form a residual compressive stress of 30 MPa to 650 MPa in the surface layer and to suppress fracture by performing shot peening at a location at which the residual tensile stress of the surface layer is 500 MPa or more in the cold-molded member.

However, in Patent Literature 3, it is necessary to newly perform shot peening after the secondary working and there is a problem that the manufacturing cost increases as the number of processes increases. Moreover, it is impossible to obtain a high elastic constant for securing firm rigidity of a structure only by shot peening.

CITATION LIST

Patent Literature

Patent Literature 1: JP-A-2012-026040
Patent Literature 2: JP-A-2009-249698
Patent Literature 3: JP-A-2017-125229

Non Patent Literature

Non Patent Literature 1: Tadanobu INOUE; "Strain variations on rolling condition in accumulative roll-bonding by finite element analysis"; "Finite Element Analysis" Chapter 24, p. 589-p. 610 (2010), https://www.intechopen.com/books/finite-element-analysis

SUMMARY OF INVENTION

Technical Problem

The present invention has been made in view of the above problems, and a first object is to provide a novel steel material which has a plate shape and achieves both high strength and high rigidity without requiring additional elements other than the constituent elements of the steel material at all, and a method for manufacturing the same in a first embodiment.

In a second embodiment, a second object is to provide a method for manufacturing a steel plate, by which a residual compressive stress can be imparted to a surface layer by a simple technique while increases in strength and rigidity are achieved.

Solution to Problem

As a result of intensive investigations, the present inventors have found out that the first object can be achieved by a first embodiment of the present invention. The specific constitution is as follows.

(1) A high-strength and high-rigidity steel plate consisting of 0.05% to 04% by mass of C,
1.65% by mass or less of Mn,
0.55% by mass or less of Si,
0.040% by mass or less of P, and
0.30% by mass or less of S,
with the balance being Fe and inevitable impurities, wherein
an average grain size of a metallographic structure at a plate thickness center portion is in a range of 0.8 μm to 2.0 μm, an average grain size of metallographic structure at a surface layer portion is in a range of 0.3 μm to 2.0 μm, and
an estimated value of Young's modulus obtained according to the following formula at a plate thickness center portion or a surface layer portion is 210 GPa or more.

(Estimated value of Young's modulus)=$f_{001}$×132 [GPa]+$f_{111}$×283 [GPa]+(1−$f_{001}$−$f_{111}$)×208 [GPa]

Where $f_{001}$ represents an accumulation rate of a <001> orientation with respect to a load axis, $f_{111}$ represents an accumulation rate of a <111> orientation, and (1−$f_{001}$−$f_{111}$) represents an accumulation rate of crystal orientations except the <001> orientation and the <111> orientation.

(2) The high-strength and high-rigidity steel plate according to (1), in which the Young's modulus at the plate thickness center portion or surface layer portion is 210 GPa or more in a case in which a tensile direction in a tensile test is at least any one of a rolling direction, a plate width direction, or a direction forming an angle difference of 45 degrees from the rolling direction and the plate width direction.

(3) The high-strength and high-rigidity steel plate according to (1) or (2), in which a yield strength at the plate thickness center portion or surface layer portion is 580 MPa or more.

(4) The high-strength and high-rigidity steel plate according to any one of (1) to (3), in which an orientation accumulation rate of a texture at the plate thickness center portion is in a range of 0% to 5% in a rolling direction, in a range of 0% to 5% in a plate width direction, and in a range of 14% to 24% in a 45-degree oblique direction in a <001> orientation and in a range of 0% to 5% in a rolling direction, in a range of 34% to 44% in a plate width direction, and in a range of 0% to 5% in a 45-degree oblique direction in a <111> orientation, and an orientation accumulation rate of a texture at the surface layer portion is in a range of 20% to 30% in a rolling direction, in a range of 0% to 5% in a plate width direction, and in a range of 10% to 20% in a 45-degree oblique direction in a <001> orientation and in a range of 16% to 26% in a rolling direction, in a range of 12% to 22% in a plate width direction, and in a range of 15% to 25% in a 45-degree oblique direction in a <111> orientation.

(5) The high-strength and high-rigidity steel plate according to any one of (1) to (3), in which an orientation accumulation rate of a texture at the plate thickness center portion is in a range of 0% to 5% in a rolling direction, in a range of 0% to 5% in a plate width direction, and in a range of 36% to 46% in a 45-degree oblique direction in a <001> orientation and in a range of 0% to 5% in a rolling direction, in a range of 2% to 12% in a plate width direction, and in a range of 0% to 5% in a 45-degree oblique direction in a <111> orientation, and an orientation accumulation rate of a texture at the surface layer portion is in a range of 10% to 20% in a rolling direction, in a range of 10% to 20% in a plate width direction, and in a range of 14% to 24% in a 45-degree oblique direction in a <001> orientation and in a range of 8% to 18% in a rolling direction, in a range of 28% to 38% in a plate width direction, and in a range of 5% to 15% in a 45-degree oblique direction in a <111> orientation.

(6) The high-strength and high-rigidity steel plate according to any one of (1) to (3), in which an orientation accumulation rate of a texture at the plate thickness center portion is in a range of 0% to 5% in a rolling direction, in a range of 0% to 5% in a plate width direction, and in a range of 12% to 22% in a 45-degree oblique direction in a <001> orientation and in a range of 0% to 5% in a rolling direction, in a range of 20% to 30% in a plate width direction, and in a range of 0% to 5% in a 45-degree oblique direction in a <111> orientation, and an orientation accumulation rate of a texture at the surface layer portion is in a range of 0% to 5% in a rolling direction, in a range of 0% to 5% in a plate width direction, and in a range of 8% to 18% in a 45-degree oblique direction in a <001> orientation and in a range of 2% to 12% in a rolling direction, in a range of 10% to 20% in a plate width direction, and in a range of 2% to 12% in a 45-degree oblique direction in a <111> orientation.

(7) The steel plate according to any one of (1) to (6), in which a difference in Young's moduli at the plate thickness center portion and the surface layer portion is 5 GPa or more.

(8) A method for manufacturing a high-strength and high-rigidity steel plate, the method including performing rolling of a steel plate or steel material at a temperature in a range of 400° C. or more and 600° C. or less using a rolling mill having a work roll diameter of 650 mm or more, the steel plate or steel material consisting of 0.05% to 0.4% by mass of C,
1.65% by mass or less of Mn,
0.55% by mass or less of Si,
0.040% by mass or less of P, and
0.30% by mass or less of S,
with the balance being Fe and inevitable impurities.

The temperature during the rolling of the steel plate or steel material is preferably in a range of 450° C. or more and 550° C. or less, and more preferably in a range of 500° C. or more and 550° C. or less.

(9) The method for manufacturing a high-strength and high-rigidity steel plate according to (8), in which the rolling is any of reverse rolling, cross rolling, or one-way rolling of the steel plate or steel material.

As a result of intensive investigations, the present inventors have found out that the second object can be achieved by a second embodiment of the present invention. The specific constitution is as follows.

(10) A structural steel plate including the high-strength and high-rigidity steel plate according to any one of (1) to (7), in which a residual compressive stress in a surface layer is 100 MPa or more.

(11) A method for manufacturing a structural steel plate, the method including imparting tensile plastic deformation to the high-strength and high-rigidity steel plate according to any one of (1) to (7).

(12) A method for manufacturing a structural steel plate, the method including performing plastic working after the rolling according to (8) or (9).

As a new method for achieving the first object, the present inventors have focused on the geometrical relationship between rolling and the material and conducted intensive investigations. There is forging, as a widely used plastic working method similar to rolling. The strain distribution of the workpiece during forging is as illustrated in the left diagram of FIG. 2 and is known to be concentrated in a particular deformation region between tools (anvil), and the distribution state in the deformation region and the amount of strain introduced into the region are determined by the ratio of the width L' of the tool to the thickness $t_0'$ of the workpiece. More specifically, nonuniform deformation occurs in which larger strain is introduced into the center portion of the workpiece as the parameter calculated by $L'/t_0'$ is a larger value. On the other hand, it is known in rolling that the deformation region generated in the workpiece is represented as illustrated in the right diagram of FIG. 2 in a case in which the workpiece is worked from the thickness $t_0$ to a thickness of $t_1$ by passing between the rolls having a roll diameter, d.

The present inventors have focused on the points of similarity in the geometric conditions between rolling and forging, which are the most efficient methods for manufacturing a steel plate material and have found out that it is possible to impart large strain to the center portion of the workpiece and to introduce large nonuniform deformation into the workpiece even by rolling similarly to the case of forging as the parameter P that can be calculated by the following formula corresponding to $L'/t_0'$ in forging is larger.

[Mathematical Formula 1]

$$P = \frac{1}{2-r}\sqrt{\frac{2dr}{t_0}} \quad (1)$$

Where, r represents the reduction in thickness, d represents the roll diameter, and $t_0$ represents the initial plate thickness (see Non Patent Literature 1).

The theory of Formula (1) has been disclosed in Non Patent Literature 1. However, it is not disclosed in Non Patent Literature 1 that the geometrical conditions of rolling and forging and the orientation accumulation rate of the texture of the workpiece.

The present invention improves both high strength and high rigidity of steel material by imparting large nonuniform deformation to a carbon steel plate material through rolling using a large-diameter work roll to refine the crystal grains of the metallographic structure and by controlling the orientation accumulation rate of the texture. As used herein, the large-diameter work roll refers to a work roll having a large diameter in a rolling mill to be used for rolling of a steel plate. The work roll diameter is, for example, preferably 650 mm or more and more preferably 870 mm or more. The maximum value of work roll diameter of the rolling mill is not particularly limited but is preferably, for example, 5000 mm or less because of the reasons for the manufacturing of the rolling mill and the influence of gravity on the ground.

Generally, in rolling of a steel plate, it is intended to decrease the work roll diameter. When the work roll diameter is decreased, the contact area between the roll and the workpiece decreases and the rolling load decreases, thus the workability and working accuracy of the workpiece are improved, the roll lifetime is extended, and the maintainability of the rolling mill is enhanced. Hence, to perform rolling of a steel plate using a rolling mill having a large work roll diameter itself has not been conventionally considered to be technically meaningful.

<Description of Elements>

Carbon (C): Carbon determines the hardness of steel material. Hardness and tenacity (hardness to break) are often inversely proportional to each other. The present invention is particularly intended for thin plates and is particularly presumed for application to structural mild steel of automobiles and the like. C is an element effective for increasing the softening resistance if the steel material is mild steel. The effect of C is not obtained when the C content is less than 0.05% by mass. In addition, a decrease in toughness is caused when the C content is more than 0.4% by mass. Hence, the range of C content is set to 0.05% to 0.4% by mass. The range of C content is preferably 0.25% by mass or less. A decrease in workability due to quench hardening and the like may be caused when the C content is more than 0.25% by mass. It is more preferable as the C content is lower and the C content is preferably 0.08% or less from the viewpoint of cold rolling property and moldability of steel plate.

Manganese (Mn): Mn is an element effective for improving hardenability. The effect of Mn is not obtained when the Mn content is less than 0.10% by mass. Mn segregates and the toughness and high-temperature strength of steel material decrease when the Mn content is more than 1.65% by mass. Hence, the Mn content is set to 1.65% by mass or less since the toughness does not matter if the steel material is mild steel.

Aluminum (Al): Al is used as a deoxidizing material at the time of steelmaking, and thus a small amount of Al is inevitably mixed. It is also known that toughness is impaired when a large amount of Al is contained. Hence, it is more preferable as the Al content is lower and the Al content is desirably 0.06% by mass or less.

Nitrogen (N): N is an element to be mixed as an impurity and forms a nitride when being contained in a large amount to cause a decrease in toughness. The N content is preferably 0.010% by mass or less from the viewpoint of securing toughness.

Phosphorus (P): Phosphorus can be contained in steel as an impurity but is limited to 0.040% by mass or less in order to prevent a decrease in toughness of steel material. Phosphorus is considered to be one of the harmful elements which contribute to "low-temperature brittleness" that the steel material is fractured by a force lower than the original strength when the temperature falls below the freezing point. Moreover, the weldability is adversely affected when the phosphorus is contained in a large amount. Hence, the P content is preferably 0.040% by mass or less if the steel material is mild steel.

Sulfur (S): Sulfur can be contained in steel as an impurity, and it is known that the strength of steel material is brittle in a case in which the steel material is used in a high temperature environment, for example, at 900° C. or more depending on the sulfur content. Hence, the S content is preferably 0.30% by mass or less if the steel material is mild steel.

Silicon (Si): Silicon affects the yield point (proof stress) and tensile strength of steel material when being contained in steel. The Si content may be 0.55% by mass or less as an optional component if the steel material is mild steel.

Inevitable impurities: Elements contained as inevitable impurities in raw materials, such as recycled steel and iron scrap, include copper (Cu), tin (Sn), nickel (Ni), and chromium (Cr). These are inevitably mixed depending on the raw materials and are hardly removed by refinement.

Copper (Cu) is an element which is effective in improvement of corrosion resistance and is also effective in improvement of forging property, but the raw material price thereof is about 4870 US $ per ton (average in 2016) and is thus considerably higher than that of iron. Hence, the Cu content is desirably 0.30% by mass or less if the steel material is mild steel.

Tin (Sn) is an element which enhances temper brittleness susceptibility similar to P and is desired to be contained as little as possible. The raw material price of Sn is about 18,000 US $ per ton (average in 2016) and is thus considerably higher than that of iron. Hence, the Sn content is desirably 0.02% by mass or less if the steel material is mild steel.

Nickel (Ni) is an element which enhances the strength and toughness at room temperature, but the raw material price thereof is about 9600 US $ per ton (average in 2016) and is thus considerably higher than that of iron. Hence, the Ni content is desirably 0.10% by mass or less if the steel material is mild steel.

Chromium (Cr) is an element which imparts oxidation resistance and corrosion resistance, but the raw material price thereof is about 2900 US $ per ton (average in 2016) and is thus considerably higher than that of iron. Hence, the Cr content is desirably 0.20% by mass or less if the steel material is mild steel.

Advantageous Effects of Invention

According to the steel plate of the present invention, it is possible to obtain a high-strength and high-rigidity steel plate having a fine crystal grain structure, different textures in the plate thickness center portion and the surface layer portion, and a large Young's modulus in a particular direction such as a rolling direction, a plate width direction, and a 45-degree oblique direction as compared with general-purpose low-carbon steel, for example, steel plates having elemental compositions corresponding to a rolled steel material for general structure (SS) defined by JIS-G3101 and a rolled steel material for welded structure (SM) defined by JIS-G3106.

According to the method for manufacturing a steel plate of the present invention, it is possible to manufacture a steel plate which has high strength and high rigidity and can achieve both high strength and high rigidity by performing rolling using a large-diameter work roll in a warm temperature region. In other words, nonuniform deformation with large strain is imparted to a material by the large-diameter work roll used in the present invention, and it is thus possible to achieve both refinement of the crystal grains of the metallographic structure and increases in strength and rigidity by control of the orientation accumulation rate of texture.

In addition, the structural steel plate of the present invention is a steel plate having a residual compressive stress of 100 MPa or more in the surface layer, and such a structural steel plate can be obtained by optionally imparting tensile plastic deformation to the steel plate of the present invention having different Young's moduli at the plate thickness center portion and the surface layer portion.

DESCRIPTION OF EMBODIMENTS

Figure 1:
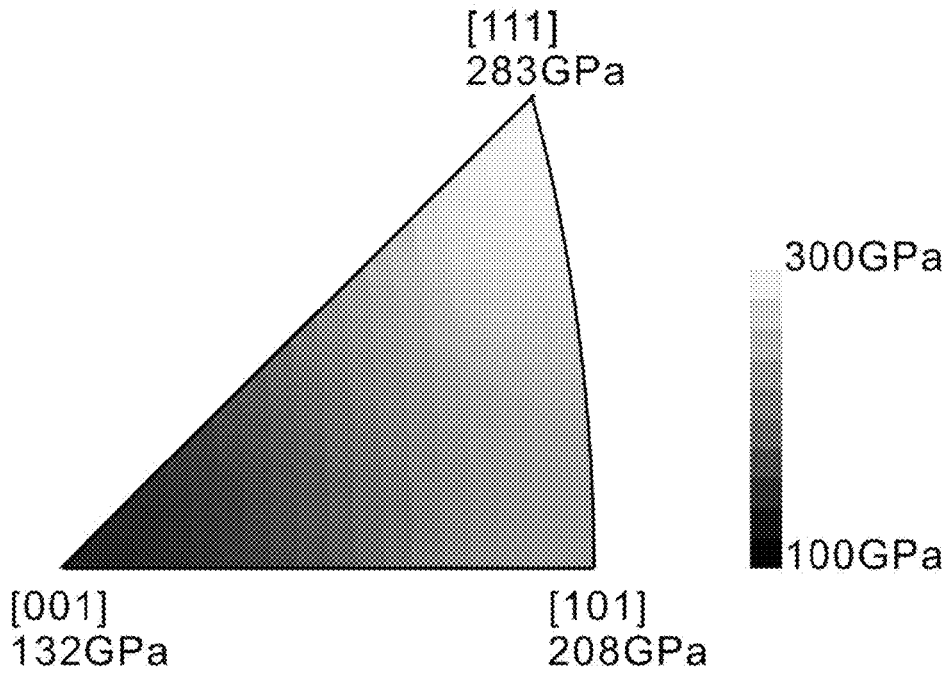
FIG. 1 illustrates one aspect of a first embodiment of the present invention and is a diagram illustrating the relationship between Young's modulus and load axis crystal orientation obtained in uniaxial deformation of pure iron single crystal.
Figure 2:
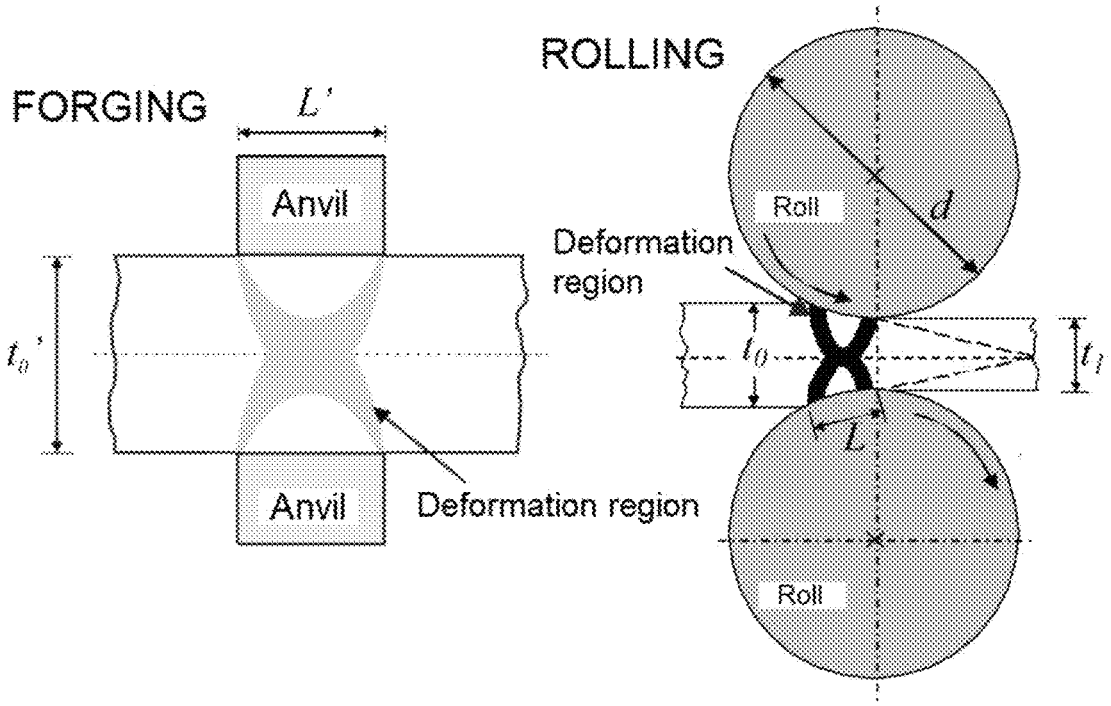
FIG. 2 illustrates one aspect of a first embodiment of the present invention and is a diagram schematically illustrating a deformation region generated in a workpiece during forging and flat rolling.

In the present specification, the "plate thickness center portion" of a steel plate refers to a center part among three parts obtained by dividing a steel plate (steel material having a plate shape) after being rolled using a rolling mill in a plate thickness direction. In other words, assuming that the plate thickness of the steel plate is t, the plate thickness center portion is in a range to be one-third in the plate thickness direction (t×1/3 to t×2/3) with a half of the plate thickness (t) as the center.

In the present specification, the "surface layer portion" of a steel plate refers to two parts except the plate thickness center part of a steel plate (steel material having a plate shape) after being rolled using a rolling mill. In other words, assuming that the plate thickness of the steel plate is t, one surface layer portion is in a range to be one-third in the plate thickness direction (t×0/3 to t×1/3) with respect to the upper surface and the other surface layer portion is in a range to be one-third in the plate thickness direction (t×3/3 to t×2/3) with respect to the lower surface.

It should be understood that the definitions of the "plate thickness center portion" and "surface layer portion" are for convenience of evaluating the metallographic structure and texture of the steel material of the present invention and the boundary between the plate thickness center portion and the surface layer portion is not necessarily clear in an actual steel material.

In addition, it should be noted that in a steel plate (for example, the structural steel material of the present invention) obtained by subjecting a steel plate after being rolled to secondary working such as tensile plastic deformation, the ratio of the ranges of the plate thickness center portion and surface layer portion in the plate thickness before the secondary working may be different from the ratio of the ranges of the plate thickness center portion and surface layer portion in the plate thickness after the secondary working.

With regard to this point, in the FEM analysis to be described below, in the tensile test piece which has a plate thickness of 3 mm and is used as the analysis model, a region to be one-third of the plate thickness, namely, a range to be one-sixth (0.5 mm) in the plate thickness direction (1.0 mm in total) with respect to the upper surface or lower surface of the test piece is taken as the surface layer portion and a region to be two-thirds of the plate thickness except the surface layer portion, namely, a range to be two-thirds in the plate thickness direction (2.0 mm) with a half of the plate thickness of the test piece as the center is taken as the plate thickness center portion.

Hereinafter, the first embodiment of the present invention will be specifically described with reference to Examples, In Examples of the first embodiment, low-carbon steel (0.15% C-0.3% Si-1.5% Mn-0.03% Al-0,002% N-balance Fe) was used.

Examples of First Embodiment

With regard to the respective Examples and Comparative Examples presented in Table 1, plate materials were manufactured by way of experiment and evaluated through the tensile test, measurement of Young's modulus, scanning electron microscopic observation, and texture measurement.

<Fabrication of Rolled Material>

As Examples, low-carbon steel having a thickness of 45 mm, a width of 95 mm, and a length of 119 mm was used as a base material to be rolled. Prior to rolling, the base material had been subjected to quenching as a preliminary heat treatment for homogenization. The base material was subjected to rolling in Examples 1 to 3 using a two-high rolling mill having a large work roll with a diameter of 870 mm. The rolling process in Examples includes three stages, The three stages are as follows:

(i) First stage: a stage of holding and heating the base material for 1 hour in an electric furnace set at 500° C., then rolling the base material to a thickness of 20 mm by 10 passes, and subjecting the rolled base material to water cooling.

(ii) Second stage: a stage of introducing the base material to an electric furnace set at 500° C. again after the first stage, holding and heating the base material for 1 hour, then rolling the base material to a thickness of 9 mm by 9 passes, and subjecting the rolled base material to water cooling, and (iii) Third stage: a stage of introducing the base material to an electric furnace set at 5000° C. again after the second stage, holding and heating the base material for 1 hour, and then rolling the base material to a thickness of 3 mm by 8 passes.

Figure 3:
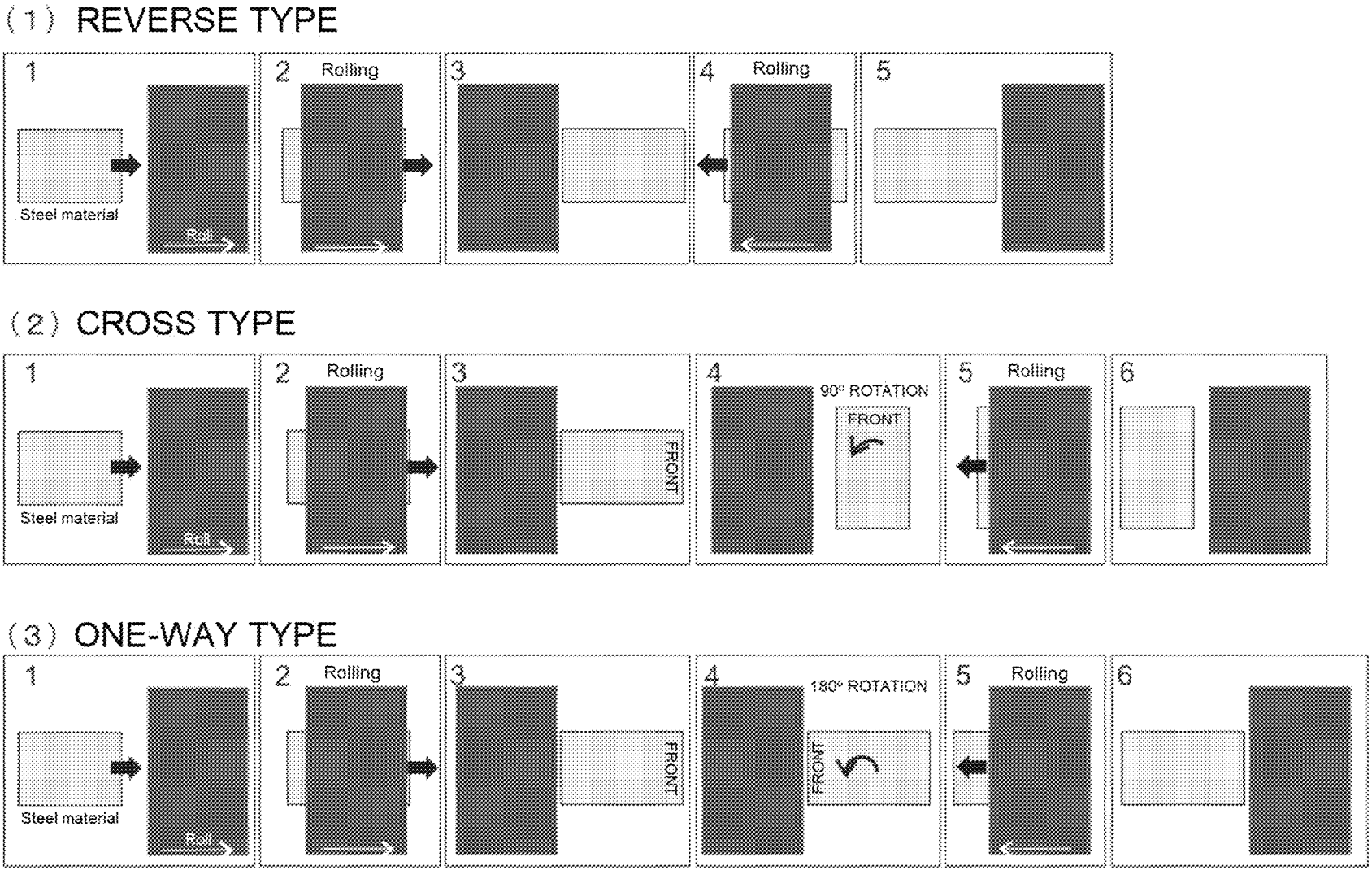
FIGS. 3(1) to 3(3) are schematic diagrams illustrating a reverse type (reverse rolling), a cross type (cross rolling), and a one-way type (one-way rolling), respectively, which are types of steel material rotation between passes.

The reheating temperature of the workpiece when rolling was performed was set to 500° C. that is a typical temperature in the warm region in which a decrease in deformation resistance of the material can be achieved and the strain release by recrystallization does not occur. The temperature in the warm region is preferably set to a range of 400° C. or more and 600° C. or less. In order to maintain the workpiece at a predetermined temperature, the workpiece was returned to the furnace every one to three passes in each stage and reheated by holding the workpiece at the predetermined temperature. Generally, the plate rolling process can be classified into three types of a reverse type (reverse rolling), a cross type (cross rolling), and a one-way type (one-way rolling) depending on the method for changing the direction of the steel material between passes as illustrated in FIGS. 3(1) to 3(3). In the reverse type illustrated in FIG. 3(1), the rolling direction of the steel material is reversed between the passes by allowing the steel material to pass between the rolls (numbers 1 to 3) and then allowing the steel material to pass between the counter-rotating rolls (numbers 4 and 5) without changing the direction of the steel material. In the cross type illustrated in FIG. 3(2), the rolling direction of the steel material crosses (intersects) between passes by allowing the steel material to pass between the rolls (numbers 1 to 3) and then allowing the steel material to pass between the counter-rotating rolls (numbers 5 and 6) in a state in which the direction of the steel material is rotated by 90° as illustrated in number 4. In the one-way type illustrated in FIG. 3(3), the rolling direction of the steel material is not changed between passes but is one direction by allowing the steel material to pass between the rolls (numbers 1 to 3), then rotating the direction of the steel material by 180° as illustrated in number 4, and allowing the steel material to pass between the counter-rotating rolls (numbers 5 and 6). The rotation of steel material between passes greatly affects particularly the metallographic structure and texture and the effect is expected to increase as the reduction at the time of rolling increases, and thus each of the three types was performed in the third stage. In the following, the "rolling direction" and "plate width direction" of a rolled material refer to the rolling direction and the plate width direction when being finally rolled in the working process, <Fabrication of Hot Rolled Material and Dual-Phase Rolled Material>

As a comparative material, the same low-carbon steel as one used as the base material of Examples was rolled under various conditions. The process conditions under which rolling was performed are presented in Table 1. In Comparative Example 1, hot rolling was performed. In other words, the base material having a shape with a thickness of 40 mm, a width of 40 mm, and a length of 50 mm was heated again by being held in an electric furnace set at 1000° C. for 1 hour and then rolled to a thickness of 3 mm by 15 passes using a two-high rolling mill having a work roll diameter of 305 mm. In addition, the base material was air-cooled after being rolled. The process conditions in Comparative Example 2 are the same as those in Comparative Example 1 except that the reheating temperature before rolling is set to 750° C. The temperature of 750° C. is a dual-phase temperature in which ferrite and austenite coexist in an equilibrium state, and thus the process corresponds to one that is called dual-phase rolling,

TABLE 1

| | Shape of base material | Work roll diameter of rolling mill | Rolling process |
|---|---|---|---|
| Example 1 | 45 mm thick × 95 mm wide × 119 mm long | 870 mm | (1) Heated at 500° C. for 1 hour, then rolled to thickness of 20 mm by 10 passes, and then water-cooled. Rolling direction is rotated by 180 degrees between respective passes (reverse type)<br>(2) Heated at 500° C. for 1 hour, then rotted to thickness of 9 mm by 9 passes, and then water-cooled. Rolling direction is rotated by 180 degrees between respective passes (reverse type)<br>(3) Heated at 500° C. for 1 hour, then rolled to thickness of 3 mm by 8 passes, and then water-cooled. Rolling direction is rotated by 180 degrees between respective passes (Reverse type) |
| Example 2 | Same as above | Same as above | (1) Heated at 500° C. for 1 hour, then rolled to thickness of 20 mm by 10 passes, and then water-cooled. Rolling direction is rotated by 180 degrees between respective passes (reverse type)<br>(2) Heated at 500° C. for 1 hour, then rolled to thickness of 9 mm by 9 passes, and then water-cooled. Rolling direction is rotated by 180 degrees between respective passes (reverse type)<br>(3) Heated at 500° C. for 1 hour, then rolled to thickness of 3 mm by 8 passes, and then water-cooled. Rolling direction is rotated by 90 degrees between respective passes (Cross type) |
| Example 3 | Same as above | Same as above | (1) Heated at 500° C. for 1 hour, then rolled to thickness of 20 mm by 10 passes, and then water-cooled. Rolling direction is rotated by 180 degrees between respective passes (reverse type)<br>(2) Heated at 500° C. for 1 tour, then rolled to thickness of 9 mm by 9 passes, and then water-cooled. Railing direction is rotated by 180 degrees between respective passes (reverse type)<br>(3) Heated at 500° C. tor 1 hour, then rolled to thickness of 3 mm by 8 passes, and then water-cooled. Rolling directions are all same in respective passes (One-way type) |
| Comparative Example 1 | 40 mm thick × 40 mm wide × 50 mm long | 305 mm | Heated at 1000° C. for 1 hour, then rolled to thickness of 3 mm by 15 passes, and then air-cooled. (Hot rolling) |
| Comparative Example 2 | Same as above | Same as above | Heated at 750° C. for 1 hour, then rolled to thickness of 3 mm by 15 passes, and then air-cooled. (Dual-phase rolling) |

(In rolling in each case, reheating treatment in fumace was performed every 1 to 3 passes for reheating.)

<Measurement of Young's Modulus and Tensile Test>

The Young's modulus was measured by a tensile test. In order to measure the local Young's modulus at the plate thickness center portion and the surface layer portion, as the tensile test piece, a small flat test piece having a plate thickness of 1 mm, a parallel portion width of 3 mm, a parallel portion length of 12 mm, and a piece portion radius of 3 mm was used. The test piece was cut out from each steel material through cutting and wire electric discharge machining so that the tensile axis formed an angle of 0 degrees, 45 degrees, or 90 degrees with the rolling direction. The measurement of displacement at the parallel portion used in the measurement of Young's modulus was performed by attaching a strain gauge (KFGS-1N-120-C1-11L1M2R manufactured by Kyowa Electronic Instruments Co., Ltd.) to the front and back surfaces at the center of the parallel portion of the test piece with an adhesive (CC-33A manufactured by Kyowa Electronic Instruments Co., Ltd.). The tensile test was performed at room temperature and a test speed of 0.33 mm/min, and the Young's modulus was obtained from the slope of the stress-strain curve when the load stress was from 20 MPa to 120 MPa. Furthermore, the tensile test was performed until the test piece was fractured, and the yield strength and the tensile strength were determined. In the stress-strain curve measured in the present investigation, both one exhibiting the yield point drop phenomenon and one not exhibiting the yield point drop phenomenon were recognized together as the behavior in the vicinity of the yield point. Hence, the yield strength was evaluated based on the stress at which the plastic strain was 0.2% regardless of the presence or absence of yield point drop phenomenon.

<Observation of Structure Under Scanning Electron Microscope>

The steel plate obtained was cut parallel to the plane with the plate width direction as the normal direction, the cross section thereof mirrored through mechanical polishing and electrolytic polishing was subjected to the electron backscatter diffraction (EBSD) measurement using a scanning electron microscope, and the metallographic structure and texture at the plate thickness center portion and surface layer portion were measured. The metallographic structure was evaluated by a boundary map in which the crystal orientation difference between adjacent measurement points was calculated using the crystal orientation data at the respective measurement points obtained by EBSD measurement, and a line was drawn assuming that there was a grain boundary if the crystal orientation difference is 15 degrees or more. The texture was evaluated based on the 001 pole figure and the accumulation rates of <111> and <001> in a direction (measurement direction) that was parallel to the plate surface and at a specific angle from the rolling direction. The accumulation rate was calculated as the proportion of the measurement location at which the angle between the measurement direction and the crystal orientation (<111> or <001>) to be measured was within 15 degrees in the entire measurement region.

As illustrated in FIG. 1, the Young's modulus is 283 GPa in a case in which the crystal orientation <111> is taken as the load axis, the Young's modulus is 208 GPa in a case in which the crystal orientation <101> is taken as the load axis, and the Young's modulus is 132 GPa in a case in which the crystal orientation <001> is taken as the load axis. The Young's modulus in a case in which the crystal orientation <111> is taken as the load axis is the largest, and the Young's modulus in a case in which the crystal orientation <001> is taken as the load axis is the smallest.

Investigation of Examples and Comparative Examples

Table 2 shows the Young's modulus, yield strength, and tensile strength obtained by the tensile test of the rolled materials fabricated as Examples and Comparative Examples.

TABLE 2

| | Test piece-taken position | Angle between tensile direction and rolling direction | Young's modulus (GPa) | Yield strength (MPa) | Tensile strength (MPa) |
|---|---|---|---|---|---|
| Example 1 | Plate thickness center portion | 0 degrees | 219 | 687 | 721 |
| | | 45 degrees | 186 | 625 | 650 |
| | | 90 degrees | 245 | 749 | 766 |
| | Surface layer portion | 0 degrees | 204 | 708 | 714 |
| | | 45 degrees | 200 | 123 | 729 |
| | | 90 degrees | 284 | 772 | 777 |
| Example 2 | Plate thickness center portion | 0 degrees | 223 | 632 | 607 |
| | | 45 degrees | 180 | 592 | 632 |
| | | 90 degrees | 223 | 606 | 676 |
| | Surface layer portion | 0 degrees | 211 | 707 | 707 |
| | | 45 degrees | 198 | 717 | 723 |
| | | 90 degrees | 221 | 715 | 717 |
| Example 3 | Plate thickness center portion | 0 degrees | 224 | 704 | 733 |
| | | 45 degrees | 190 | 668 | 635 |
| | | 90 degrees | 249 | 786 | 794 |
| | Surface layer portion | 0 degrees | 219 | 754 | 774 |
| | | 45 degrees | 198 | 746 | 731 |
| | | 90 degrees | 235 | 800 | 843 |
| Comparative Example 1 | Plate thickness center portion | 0 degrees | 209 | 361 | 540 |
| | | 45 degrees | 208 | 364 | 540 |
| | | 90 degrees | 213 | 363 | 541 |
| | Surface layer portion | 0 degrees | 205 | 353 | 527 |
| | | 45 degrees | 209 | 355 | 831 |
| | | 90 degrees | 209 | 357 | 531 |
| Comparative Example 2 | Plate thickness center portion | 0 degrees | 207 | 313 | 751 |
| | | 45 degrees | 186 | 300 | 732 |
| | | 90 degrees | 224 | 338 | 714 |

TABLE 2-continued

| | Test piece-taken position | Angle between tensile direction and rolling direction | Young's modulus (GPa) | Yield strength (MPa) | Tensile strength (MPa) |
|---|---|---|---|---|---|
| | Surface layer portion | 0 degrees | 180 | 312 | 719 |
| | | 45 degrees | 204 | 329 | 728 |
| | | 90 degrees | 213 | 361 | 701 |

* Measurement was performed two times under each condition and average value of measurement results is presented.

Figure 4:
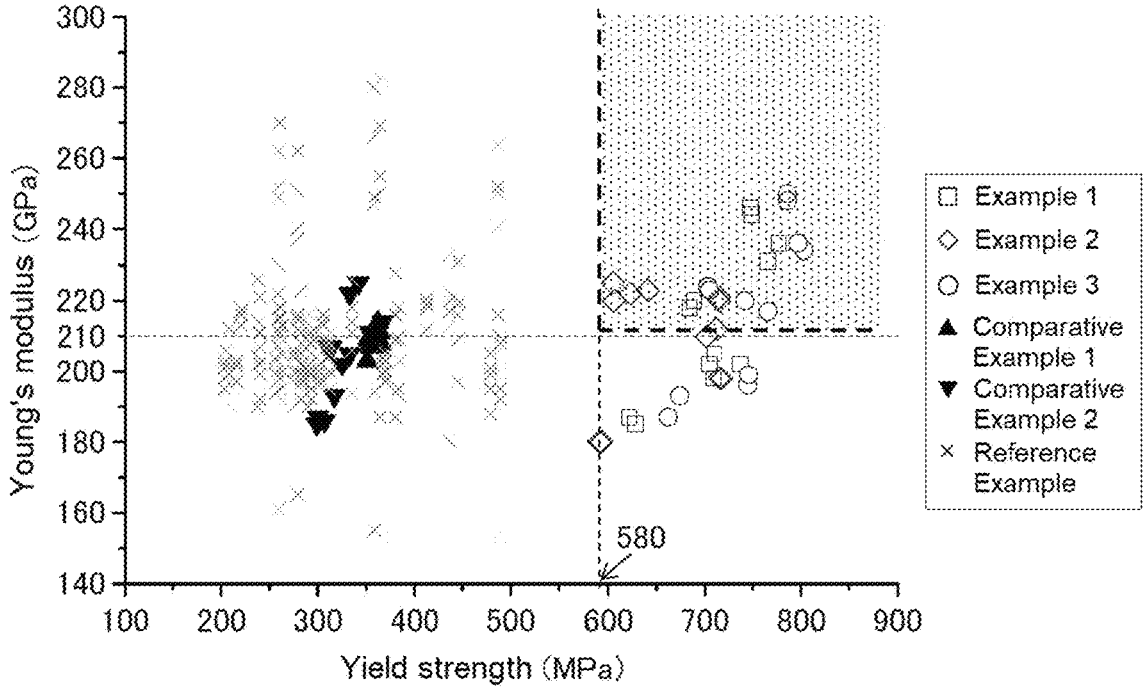
FIG. 4 is a graph illustrating the relationship between the Young's modulus and yield strength of low-carbon steel plates manufactured by way of experiment through large-diameter roll rolling (Examples 1, 2, and 3), hot rolling (Comparative Example 1), and dual-phase rolling (Comparative Example 2)

The relationship between Young's modulus and yield strength determined using the data in Table 2 is illustrated in FIG. 4. The data presented in Examples and Comparative Examples in Patent Literature 2 are also illustrated in FIG. 4 as Reference Example. In Comparative Example 1, Comparative Example 2, and Reference Example, a case having a high Young's modulus of 210 GPa or more was partially recognized but the yield strengths were all 500 MPa or less to be relatively low. On the other hand, in Examples, data having a high Young's modulus of 210 GPa or more and having a yield strength of 580 MPa or more were recognized at one or more points in any of the processes. This means that the yield strength is 580 MPa or more and the Young's modulus at the plate thickness center portion or the surface layer portion is 210 GPa or more in a case in which the tensile direction is any of a rolling direction, a plate width direction, or a direction forming an angle difference of 45 degrees from the rolling direction and the plate width direction.

Figure 5:
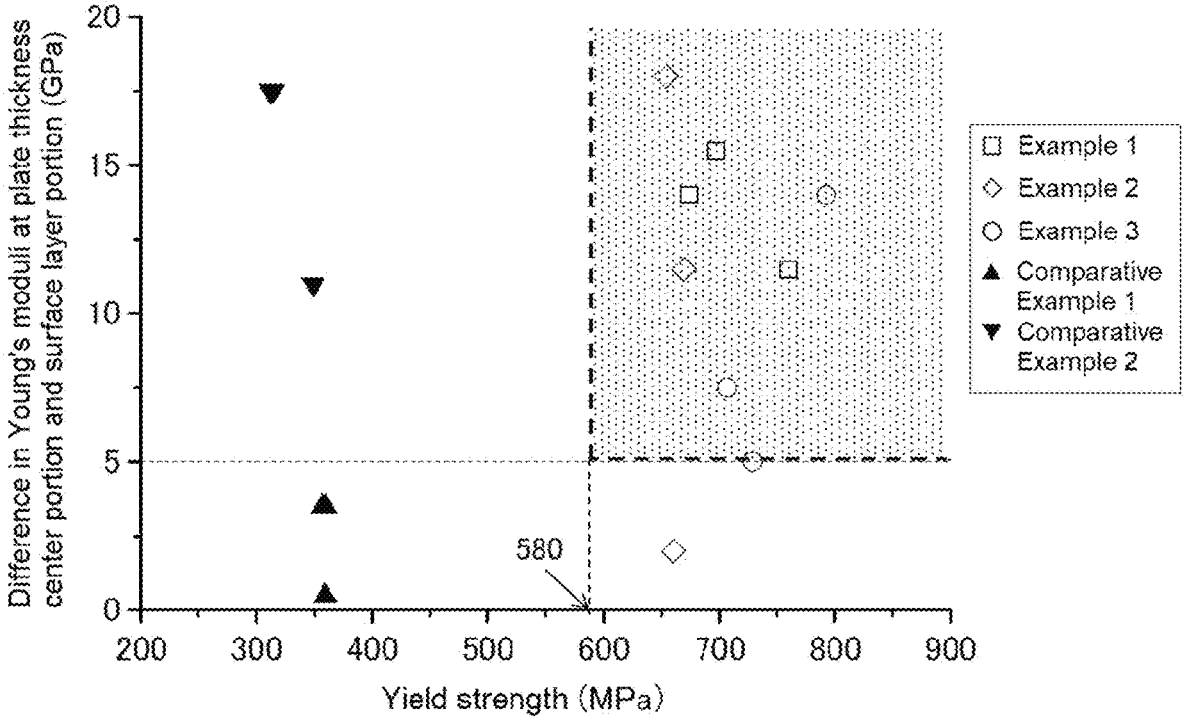
FIG. 5 is a graph illustrating the relationship between the difference in Young's moduli at the plate thickness center portion and surface layer portion and the yield strength of low-carbon steel plates manufactured by way of experiment through large-diameter roll rolling (Examples 1, 2, and 3), hot rolling (Comparative Example 1), and dual-phase rolling (Comparative Example 2).

The difference in Young's moduli at the plate thickness center portion and the surface layer portion is calculated from the data in Table 1, and the relationship between the value and the yield strength is illustrated in FIG. 5. When there is a large difference in Young's moduli in the plate thickness direction of the same plate material, a difference in elastic strain generated when the plate material is deformed is likely to be caused. As a result, an increase in deformation resistance is expected, and it is thus desirable that the difference in Young's moduli is large. In these trial materials, the difference in Young's moduli was a large value of 5 GPa or more (corresponding to 2% or more of 205 GPa, which was the Young's modulus of steel material in the "Steel Structure Design Standards" by Architectural Institute of Japan) that could be judged as a significant difference in any direction in all Examples and Comparative Example 2. Among the trial steel materials having a large difference in Young's moduli, those having a yield strength of 580 MPa or more were only Examples.

From the results of the tensile test presented above, in Examples, it has been demonstrated that two points of (1) that the yield strength is a high strength of 580 MPa or more at either of the plate thickness center portion or the surface layer portion and the Young's modulus is larger than the standard Young's modulus (205 GPa) by a significant difference (5 GPa), and (2) that the yield strength is a high strength of 580 MPa or more and the difference in Young's moduli at the plate thickness center portion and the surface layer portion is a significant value (5 GPa) or more, are realized in a case in which the tensile direction is any of a rolling direction, a plate width direction, or a direction forming an angle difference of 45 degrees from the rolling direction and the plate width direction. The mechanism of realizing these two excellent mechanical properties is investigated below from the viewpoint of metallographic structure and texture.

Figure 6:
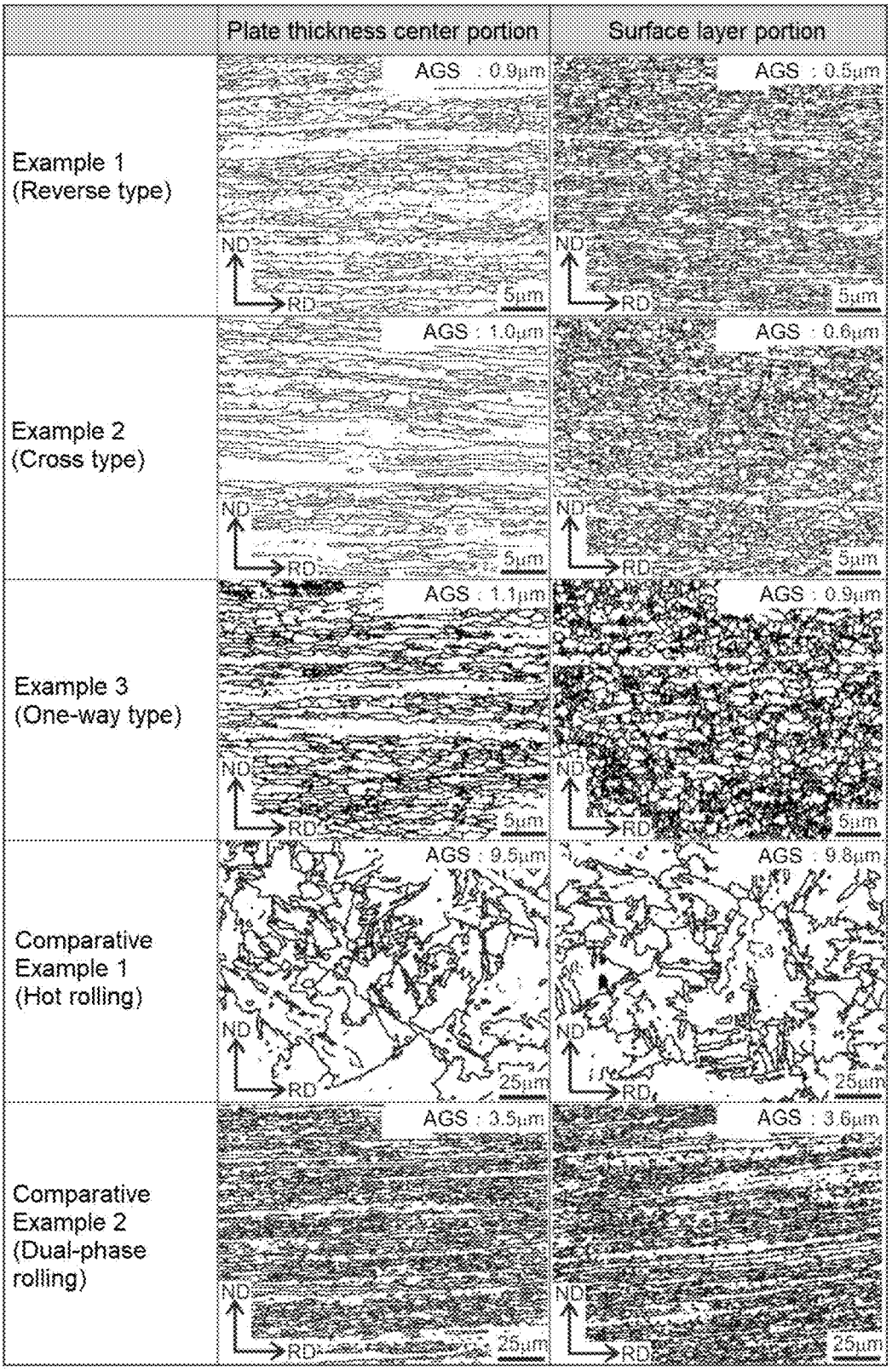
FIG. 6 illustrates diagrams illustrating the crystal grain boundary distributions at the plate thickness center portion and surface layer portion of low-carbon steel plates manufactured by way of experiment through large-diameter roll rolling (Examples 1, 2, and 3), hot rolling (Comparative Example 1), and dual-phase rolling (Comparative Example 2)

FIG. 6 illustrates boundary maps obtained by EBSD measurement of steel materials fabricated as Examples and Comparative Examples, EBSD measurement was performed at the plate thickness center portion and surface layer portion of each steel material. In addition, the average grain size determined from each data is also illustrated. In FIG. 6, the description of "Example 1 (Reverse type)" indicates that the third stage in the rolling process in Example 1 is a reverse type and the same applies to the description of "Example 2 (Cross type)" and "Example 3 (One-way type)" (see Table 1). The same also applies to FIGS. 7, 9(*a*) to 9(*d*), and 10 to be described later.

In all the boundary maps, a fine metallographic structure is observed in which the presence of a large number of crystal grain boundaries is recognized, but the forms thereof greatly differ from each other depending on the process and the measurement position. In the steel materials except Comparative Example 1, a structure elongated in the rolling direction was recognized at the plate thickness center portion and the presence of slightly equiaxed crystal grains was recognized at the surface layer portion. As compared with Comparative Example 2, it can be seen that Examples 1 to 3 have a finer structure and the surface layer portion is equiaxed. This depends on the fact that a large-diameter roll is used by which the accumulation of strain is efficient and rolling was performed in a warm region in which release of strain due to recrystallization is less likely to occur in Examples, and this has been specifically confirmed from the fact that the values of average grain sizes at both the plate thickness center portion and the surface layer portion were smaller than those in Comparative Examples. In the first embodiment of the present invention, the average grain size of the metallographic structure at the plate thickness center portion is in a range of 0.8 μm to 2.0 μm, the average grain size of the metallographic structure at the surface layer portion is preferably in a range of 0.3 μm to 2.0 μm, and this makes it possible to achieve both an increase in strength and an increase in rigidity of the steel material. Moreover, it is possible to obtain a steel material having a yield strength of 580 MPa or more as the average grain sizes at the plate thickness center portion and surface layer portion satisfy the above ranges. In Comparative Example 1, a bainitic ferrite structure having a rectangular shape was observed. This structure is a structure generated when carbon steel is continuously cooled from the austenitic region. From the boundary map illustrated in FIG. 6, it can be seen that a kind of fine grain structure was obtained in Examples 1 to 3. In other words, in the results of the tensile test described above, the reason why Examples 1 to 3 exhibited excellent high strength is that larger strain was introduced into the center portion of the base metal since a large-diameter work rolls was used and warm rolling was performed and the refinement of crystal grains in the metallographic structure was promoted since nonuniform deformation occurred in the plate thickness direction.

Figure 7:
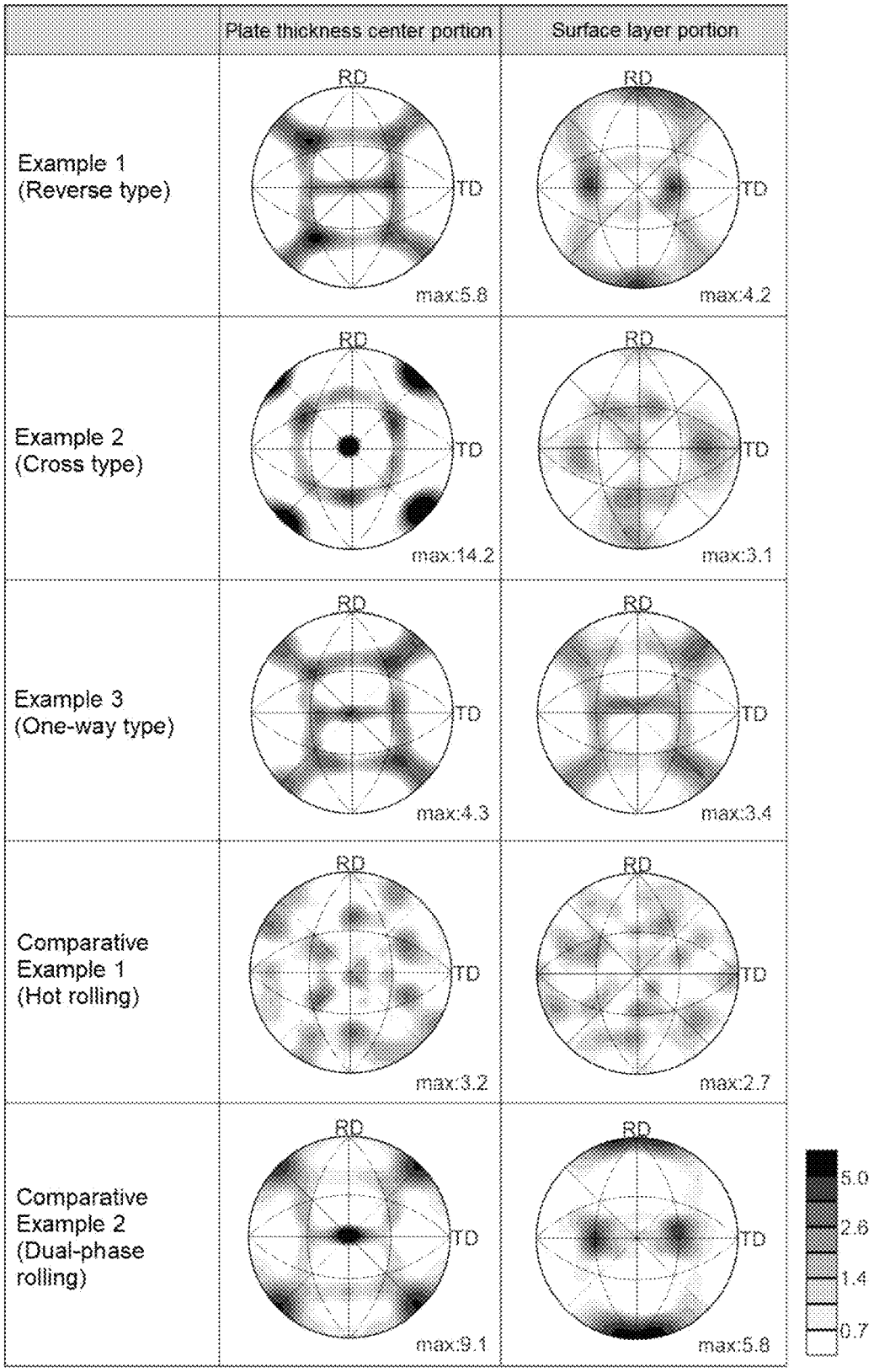
FIG. 7 illustrates positive pole figures illustrating the <001> crystal orientation distributions at the plate thickness center portion and surface layer portion of low-carbon steel plates manufactured by way of experiment through large-diameter roll rolling (Examples 1, 2, and 3), hot rolling (Comparative Example 1), and dual-phase rolling (Comparative Example 2).
Figure 8:
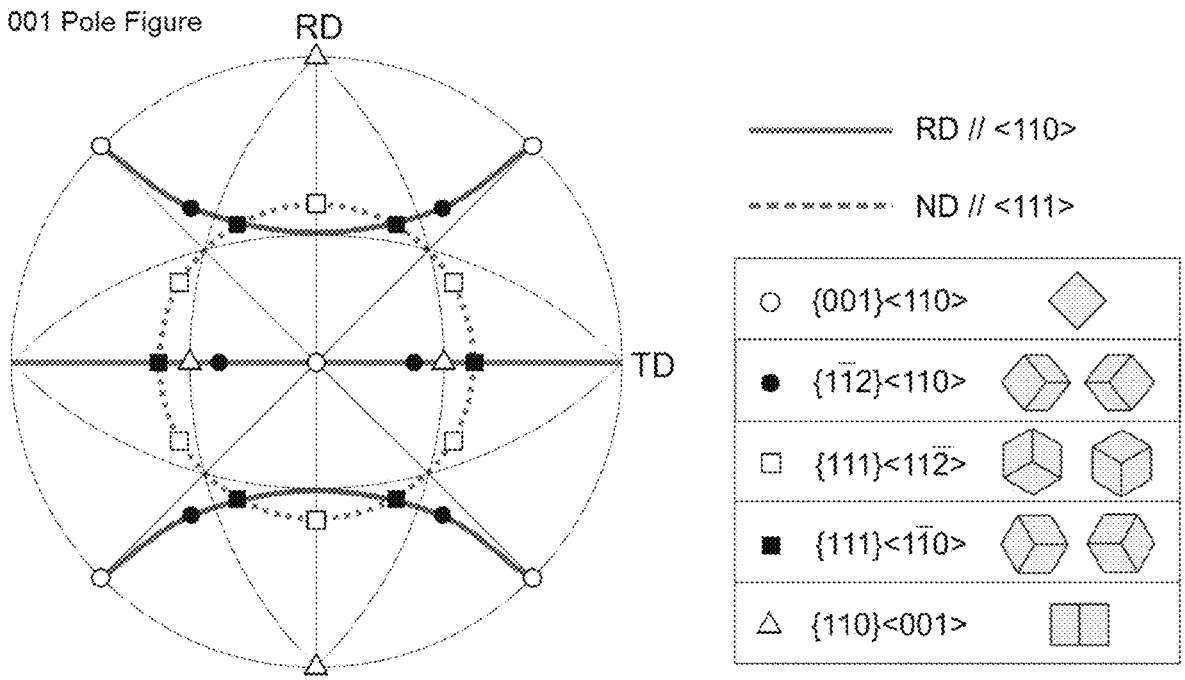
FIG. 8 illustrates a positive pole figure illustrating the <001> crystal orientation distribution typically observed in a rolled metal plate having a body-centered cubic lattice, FIGS. 9(*a*) to 9(*d*) are graphs illustrating the relationship between the accumulation of <001> crystal orientation and <111> crystal orientation and the angle from the rolling direction (RD) at the plate thickness center portion and surface layer portion of low-carbon steel plates manufactured by way of experiment through large-diameter roll rolling (Examples 1, 2, and 3), hot rolling (Comparative Example 1), and warm rolling (Comparative Example 2).

FIG. 7 illustrates 001 positive pole figures obtained by EBSD measurement of each steel plate. The horizontal direction and vertical direction in each figure are parallel to the plate width direction (TD) and the rolling direction (RD), respectively. The accumulation intensity of <001> is illustrated in gray scale. In addition, the maximum accumulation intensity (max) when the accumulation intensity of random distribution is set to 1 is added at the lower right of each pole figure. For reference, FIG. 8 schematically illustrates the distribution of <001> pole corresponding to the texture to be often observed in rolled steel materials. In the description of the symbols used in FIG. 8, the texture in which the rolling surface is parallel to the {hkl} surface and the rolling direction is parallel to <uvw> is abbreviated as {hkl}<uvw>.

Mainly in rolled steel plates, it is known that distributions having a common feature that <110> called α fiber is parallel to the rolling direction and distributions having a common feature that <111> called γ fiber is parallel to the plate thickness direction (ND) are observed. Actually, the distributions of both the α-fiber and the γ-fiber are observed together at the plate thickness center portion in Example 1 and Example 3. On the other hand, {001}<110> texture is observed in Example 2 and Comparative Example 2. This texture is known in connection with the manufacture of thick steel plates and is known to be observed at the plate thickness center portion of a steel plate obtained by performing dual-phase rolling. It is worthy of note that a texture similar to that obtained by the dual-phase rolling in Example 2 has been obtained in this manufacture by way of experiment. In addition, in Comparative Example 1, a direction exhibiting particularly intensive accumulation was not observed, and the crystal orientations were almost randomly distributed. This means that the orientation of the crystal orientation is destroyed by the phase transformation occurring during cooling after rolling since austenitic single phase rolling is performed in Comparative Example 1. A similar random distribution was also recognized at the surface layer portion of Comparative Example 1.

In the present Examples, a rolling mill having a large work roll diameter is used and it is thus expected that a strong interaction between the workpiece and the work roll occurs at the time of rolling. Actually, in Examples 1 to 3, the plate thickness center portion and the surface layer portion had different textures from each other in all cases. In Example 1, development of {011}<100> texture known as Goss orientation was observed. It is known that this is a texture which is generated in a case in which the shear deformation is remarkable at the time of rolling and is a texture generated even in dual-phase rolling as illustrated in the pole figure of the surface layer portion of Comparative Example 2. At the surface layer portions of Example 2 and Example 3, slight accumulation is recognized but the maximum accumulation intensity is about 3 to be low and there is no strong texture.

The purpose of evaluating the texture in the present investigation is to investigate the mechanism of the development of excellent high rigidity presented in the results of the tensile test described above. Various methods have been proposed for estimating the Young's modulus of a polycrystalline substance from the degree of crystal orientation and the dependency of the Young's modulus on the crystal orientation illustrated in FIG. 1. As one of the simplest methods, there is a method in which a linear combination of the accumulation density $f_{uvw}$ of the <uvw> orientation in the load axis direction and the Young's modulus $E_{uvw}$ of the <uvw> orientation in the single crystal, namely, $\Sigma f_{uvw}E_{uvw}$ (where $\Sigma f_{uvw}=1$) is calculated. In the case of a steel material having a body-centered cubic lattice, the Young's modulus is lowest in a case in which the load axis is taken as the <001> direction and is highest in a case in which the load axis is taken as the <111> direction. Hence, the accumulation rates of the <001> and <111> orientations parallel to the tensile axis direction were calculated from the EBSD measurement results.

Figure 9:
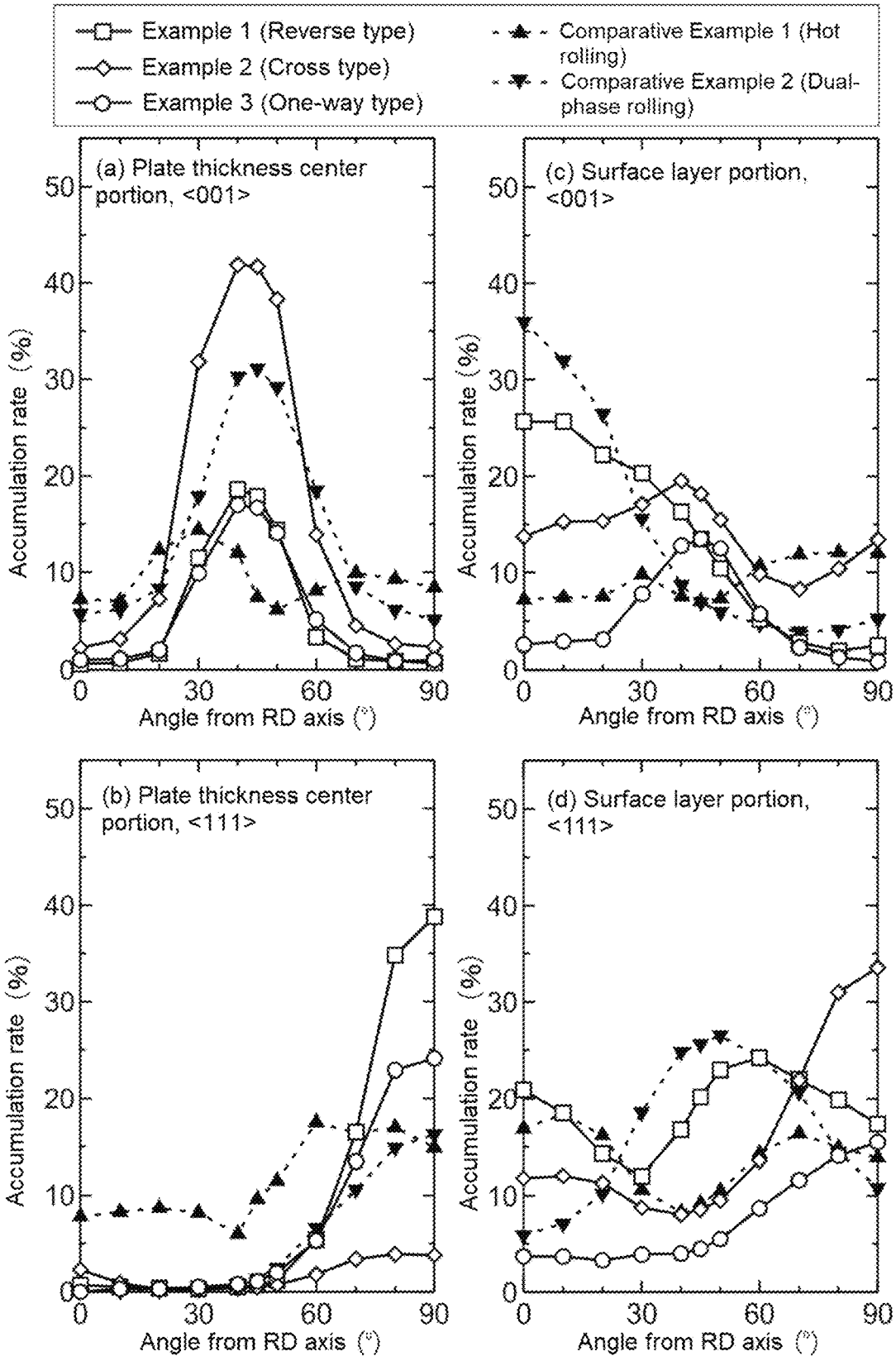

FIGS. 9(*a*) to 9(*d*) illustrate the accumulation intensities of the <001> orientation (a, c) and <111> orientation (b, d) of the texture at the plate thickness center portion (a, b) and surface layer portion (c, d) of the steel plates obtained as Examples and Comparative Examples. In each case, the orientation accumulation rate with respect to a direction which is parallel to the plate surface and forms a particular angle from the rolling direction is evaluated. For example, in the case of Example 1 (open squares), accumulation of <001> is present in the direction forming 45 degrees from the rolling direction (FIG. 9(*a*)) and <111> orientation is accumulated in the 90-degree direction (FIG. 9(*b*)) at the plate thickness center portion.

Moreover, assuming that the measurement error in the EBSD measurement is ±5%, the orientation accumulation rate of the texture in the steel plates obtained in Examples can be evaluated as follows from the results in FIGS. 9(*a*) to 9(*d*).

In the steel plate obtained in Example 1, the orientation accumulation rate of the texture at the plate thickness center portion is in a range of 0% to 5% in the rolling direction, in a range of 0% to 5% in the plate width direction, and in a range of 14% to 24% in the 45-degree oblique direction in the <001> orientation and in a range of 0% to 5% in the rolling direction, in a range of 34% to 44% in the plate width direction, and in a range of 0% to 5% in the 45-degree oblique direction in the <111> orientation. In addition, the orientation accumulation rate of the texture at the surface layer portion is in a range of 20% to 30% in the rolling direction, in a range of 0% to 5% in the plate width direction, and in a range of 10% to 20% in the 45-degree oblique direction in the <001> orientation and in a range of 16% to 26% in the rolling direction, in a range of 12% to 22% in the plate width direction, and in a range of 15% to 25% in the 45-degree oblique direction in the <111> orientation.

In the steel plate obtained in Example 2, the orientation accumulation rate of the texture at the plate thickness center portion is in a range of 0% to 5% in the rolling direction, in a range of 0% to 5% in the plate width direction, and in a range of 36% to 46% in the 45-degree oblique direction in the <001> orientation and in a range of 0% to 5% in the rolling direction, in a range of 2% to 12% in the plate width direction, and in a range of 0% to 5% in the 45-degree oblique direction in the <111> orientation. In addition, the orientation accumulation rate of the texture at the surface layer portion is in a range of 10% to 20% in the rolling direction, in a range of 10% to 20% in the plate width direction, and in a range of 14% to 24% in the 45-degree oblique direction in the <001> orientation and in a range of 8% to 18% in the rolling direction, in a range of 28% to 38% in the plate width direction, and in a range of 5% to 15% in the 45-degree oblique direction in the <111> orientation.

In the steel plate obtained in Example 3, the orientation accumulation rate of the texture at the plate thickness center portion is in a range of 0% to 5% in the rolling direction, in a range of 0% to 5% in the plate width direction, and in a range of 12% to 22% in the 45-degree oblique direction in the <001> orientation and in a range of 0% to 5% in the rolling direction, in a range of 20% to 30% in the plate width direction, and in a range of 0% to 5% in the 45-degree oblique direction in the <111> orientation. In addition, the orientation accumulation rate of the texture at the surface layer portion is in a range of 0% to 5% in the rolling direction, in a range of 0% to 5% in the plate width direction, and in a range of 8% to 18% in the 45-degree oblique direction in the <001> orientation and in a range of 2% to 12% in the rolling direction, in a range of 10% to 20% in the plate width direction, and in a range of 2% to 12% in the 45-degree oblique direction in the <111> orientation.

Furthermore, the Young's modulus estimated from the texture was calculated by linearly adding the data illustrated in FIGS. 9(*a*) to 9(*d*) to 132 GPa, 208 GPa, and 283 GPa that were the Young's moduli of <001>, <101>, and <111> orientations of iron single crystal. More specifically, assuming that the accumulation of the <001> and <111> orientations were $f_{011}$ and $f_{111}$, respectively, the Young's modulus was calculated by (estimated value of Young's modulus) $=f_{001}\times 132$ [GPa]$+f_{111}\times 283$ [GPa]$+(1-f_{001}-f_{111})\times 208$ [GPa]. Each accumulation of $f_{001}$ or $f_{111}$ was determined as a proportion of the number of measurement points at which the angle formed by the crystal orientation in the tensile axis direction obtained by EBSD measurement with the <001> or <111> orientation is within 15 degrees.

Figure 10:
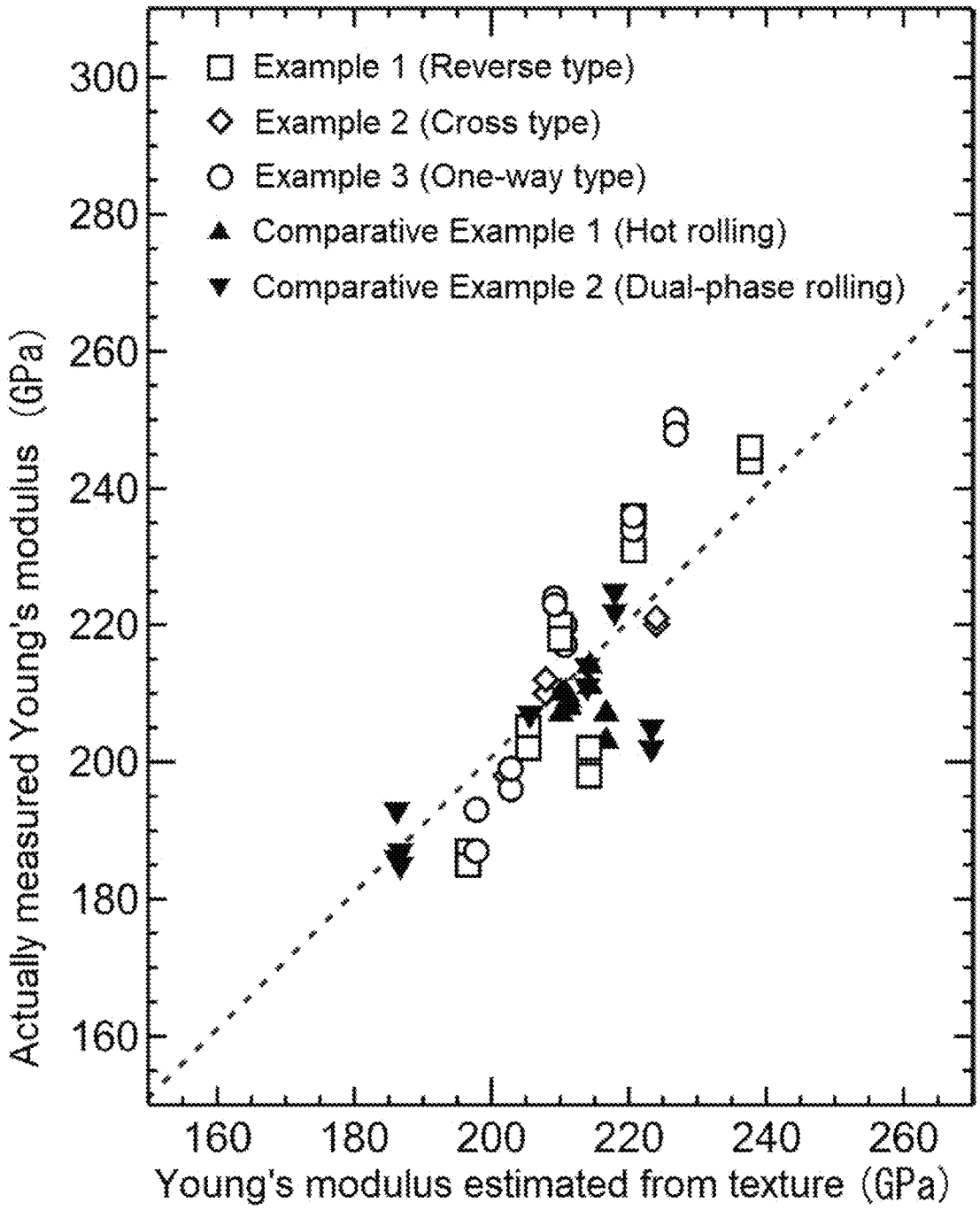
FIG. 10 is a diagram illustrating the relationship between the Young's modulus estimated from the measurement result of texture and a value of Young's modulus obtained by actual measurement.

The relationship between the Young's modulus estimated from the texture and the actually measured Young's modulus is illustrated in FIG. 10. The dotted line indicates the relationship in which the estimated value and the actually measured value are equal to each other, and it has been confirmed that the estimated value is mostly close to the actually measured value at all points. This result means that the high Young's modulus obtained this time is mainly due to the fact that the orientation accumulation rate of the texture is controlled so as to increase in any direction of the rolling direction, the plate width direction, or a direction forming an angle difference of 45 degrees from the rolling direction and the plate width direction in the <111> orientation having the highest Young's modulus in iron single crystal and to decrease in any direction of the rolling direction, the plate width direction, or a direction forming an angle difference of 45 degrees from the rolling direction and the plate width direction in the <001> orientation having the lowest Young's modulus. In Examples, a unique texture was formed because of a large-diameter work roll and thus it has been demonstrated from the results in FIG. 10 that the manufacture of steel plate using a large-diameter work roll is a factor for obtaining a high Young's modulus.

As a result, it has been indicated that warm working using a rolling mill using a large-diameter work roll is an effective means of obtaining a steel plate having both high strength and high rigidity.

Next, the second embodiment will be described.

The mechanism will be described below by which residual stress by compression can be generated at the surface layer portion by imparting tensile plastic deformation to the steel plate obtained in the first embodiment described above in a case in which the plate thickness center portion and the surface layer portion which have different Young's moduli from each other exist in a sandwich structure shape as this steel plate.

Figure 11:
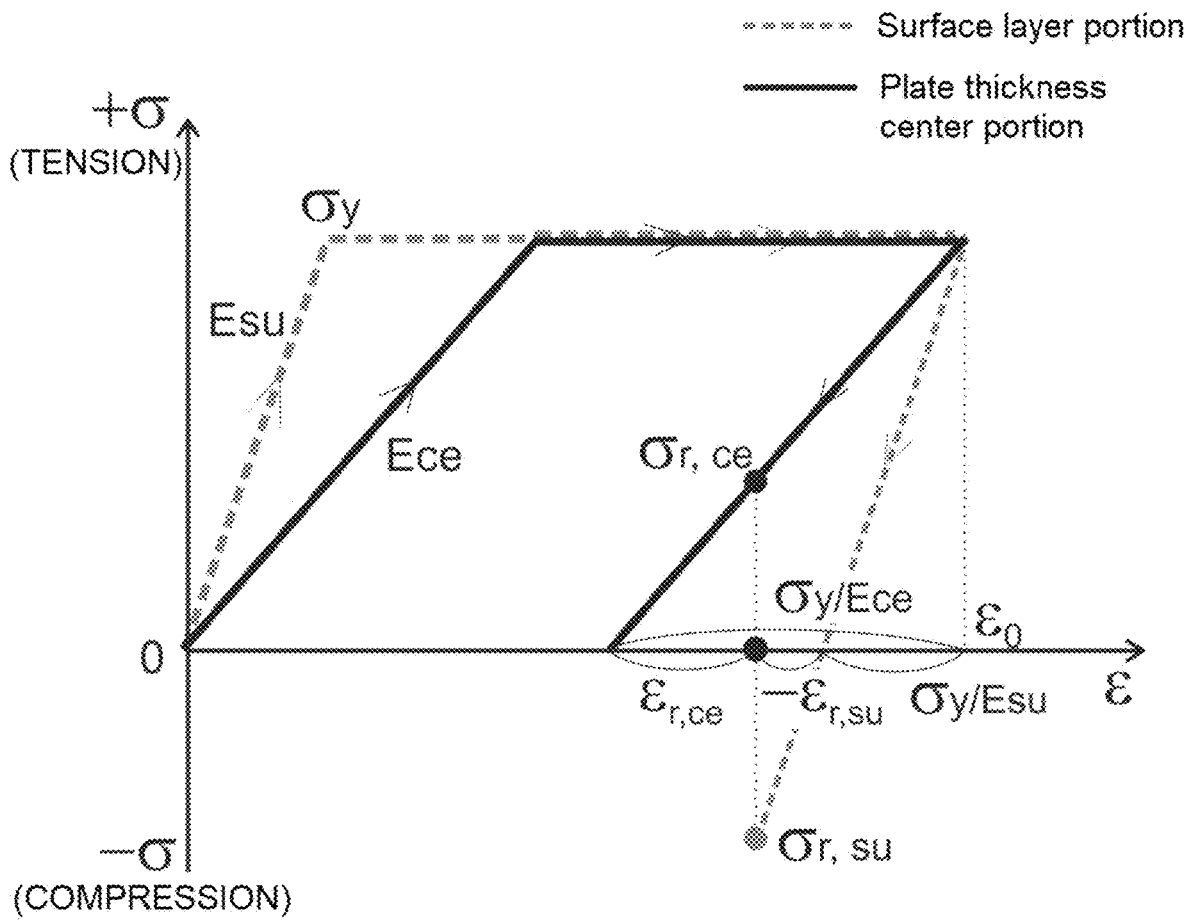
FIG. 11 illustrates one aspect of a second embodiment of the present invention and is a diagram separately illustrating a change in a stress state at a surface layer portion and a plate thickness center portion when tensile plastic deformation is imparted to a steel plate having a larger Young's modulus at the surface layer portion than at the plate thickness center portion and then the load is removed.

The changes in the stress state when plastic deformation having total strain $\varepsilon_0$ is imparted to a steel plate in which the Young's modulus at the surface layer portion is larger than the Young's modulus at the plate thickness center portion are illustrated in FIG. 11 separately for the surface layer portion and the plate thickness center portion. The horizontal axis indicates the strain, and the vertical axis indicates the stress. The stress states at the surface layer portion and plate thickness center portion are drawn by a broken line and a solid line, respectively. In order to extract and discuss the influence caused by nonuniform Young's modulus, the following assumptions are made.

(i) Both the surface layer portion and the plate thickness center portion are elastic-perfectly plastic solids.

(ii) Both the surface layer portion and the plate thickness center portion have the same yield stress (ay).

(iii) The surface layer portion and the plate thickness center portion are each uniformly deformed without being locally displaced or peeled off at the interface.

In addition, with regard to all the stresses and strains to be described below, a positive value indicates the tension and a negative value indicates the compression. In a state in which the load is maintained by imparting the total strain $\varepsilon_0$, both the surface layer portion and the plate thickness center portion are in a state of having the same stress ($\sigma_y$) and the same total strain ($\varepsilon_0$). By the difference in Young's moduli at the surface layer portion and the plate thickness center portion, nonuniformity in the stress state is caused when the load is removed. As a result, in order to completely remove the load, a stress distribution is necessary so that the surface layer portion having a large Young's modulus is in a compressive stress state and the plate thickness center portion is in a tensile stress state. This state can be written as the following formula.

[Mathematical Formula 2]

$$(1-f)\sigma_{r,ce}+f\sigma_{r,su}=0 \tag{2}$$

Where, f represents the volume fraction of the surface layer portion. In addition, $\sigma_{r,ce}$ and $\sigma_{r,su}$ represent the stresses in the tensile axis direction remaining at the plate thickness center portion and surface layer portion in a completely unloaded state, respectively. Under this deformation condition, $\sigma_{r,ce}$ has a positive value and $\sigma_{r,su}$ has a negative value. This formula indicates a stress-balancing condition.

When the Young's moduli at the surface layer portion and plate thickness center portion are represented as $E_{su}$ and $E_{ce}$ respectively, the elastic strains $\varepsilon_{r,su}$ and $\varepsilon_{r,ce}$ of the surface layer portion and plate thickness center portion in a completely unloaded state can be calculated by the following formula.

[Mathematical Formula 3]

$$E_{su}\varepsilon_{r,su}=\sigma_{r,su}E_{ce}\varepsilon_{r,ce}=\sigma_{r,ce} \tag{3}$$

The Young's modulus is a positive value, and thus $\varepsilon_{r,ce}$ has a positive value as $\sigma_{r,ce}$ and $\varepsilon_{r,su}$ has a negative value as $\sigma_{r,su}$ under this deformation condition.

Furthermore, displacement and fracture do not occur at the interface between the surface layer portion and the plate thickness center portion (assumption iii), and thus the total strains at the surface layer portion and plate thickness center portion are required to be the same value as each other even after the load is completely removed. For this purpose, the amounts of strain which disappears by unloading are required to be equal to each other at the surface layer portion and the plate thickness center portion. In other words, the sum of the absolute values of the elastic tensile strain ($\sigma_y/E_{su}$) imparted by the deformation at the surface layer portion and the elastic compressive strain ($\varepsilon_{r,su}$) generated by the stress distribution when the load is completely removed is required to be equal to the difference between the elastic tensile strain ($\sigma_y/E_{ce}$) imparted by the deformation at the plate thickness center portion and the elastic tensile strain ($\varepsilon_{r,ce}$) remaining when the load is completely removed. This situation can be described as the following formula,

[Mathematical Formula 4]

$$\frac{\sigma_y}{E_{su}}-\varepsilon_{r,su}=\frac{\sigma_y}{E_{ce}}-\varepsilon_{r,ce} \tag{4}$$

When Formula (4) is satisfied, $\varepsilon_{r,su}$ and $\varepsilon_{r,ce}$ can be geometrically illustrated as in FIG. 11.

From Formulas (2), (3) and (4) above, it is possible to obtain the following Formulas (5) and (6) for estimating the residual stresses ($\sigma_{r,su}$ and $\sigma_{r,ce}$) at the respective portions from the yield stress ($\sigma_y$), the Young's moduli ($E_{su}$ and $E_{ce}$) at the surface layer portion and plate thickness center portion, and the volume fraction (f) of the surface layer portion.

[Mathematical Formula 5]

$$\sigma_{r,su}=E_{su}\sigma_y\left(\frac{1}{E_{su}}-\frac{1}{E_{ce}}\right)\left\{1+\frac{f}{(1-f)}\frac{E_{su}}{E_{ce}}\right\}^{-1} \tag{5}$$

[Mathematical Formula 6]

$$\sigma_{r,ce}=E_{ce}\sigma_y\left(\frac{1}{E_{ce}}-\frac{1}{E_{su}}\right)\left\{1+\frac{(1-f)}{f}\frac{E_{ce}}{E_{su}}\right\}^{-1} \tag{6}$$

Figure 12:
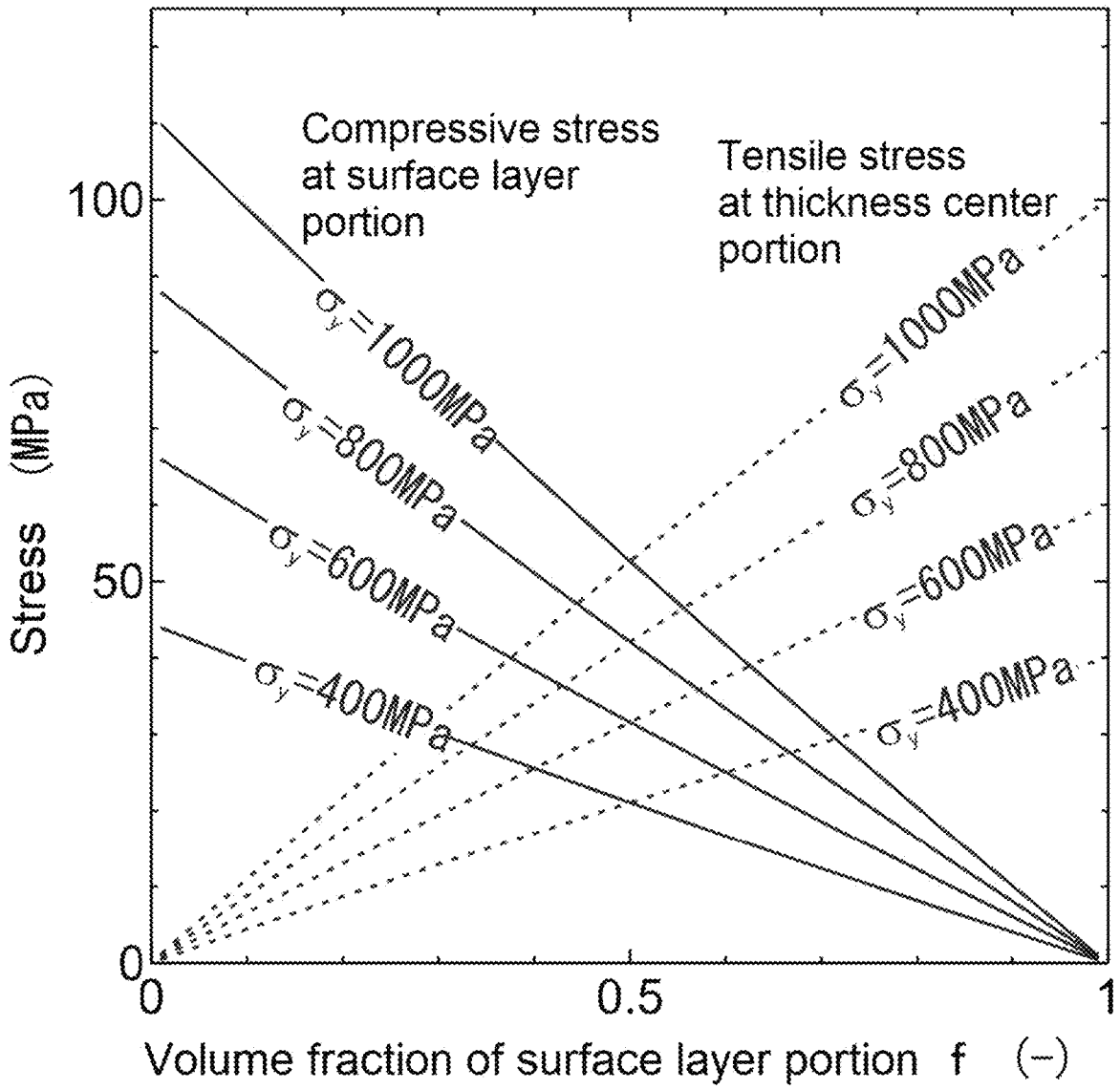
FIG. 12 illustrates one aspect of a second embodiment of the present invention and is a diagram illustrating the relationship between residual stress and yield stress/volume fraction.

For example, the results obtained by calculating the residual stress while changing the yield stress and the volume fraction and using $E_{ce}$=180 [GPa] and $E_{su}$=200 [GPa] are illustrated in FIG. 12. As the yield stress increases and the volume fraction of the surface layer portion decreases, the compressive stress in the tensile axis direction generated at the surface layer portion increases. From the manner of this change, it can be seen that the residual stress generated by the nonuniform Young's modulus obtained in the present invention tends to increase in high-strength steel such as high tensile steel.

In the discussion so far, it has been assumed that work hardening does not occur in the plastic deformation of the surface layer portion and plate thickness center portion, but work hardening actually occurs. Moreover, there is also a possibility that the stress state is nonuniform in the plate thickness direction. Hence, FEM analysis was performed based on the actually measured data for each portion, and it was verified whether or not the residual stress was able to be imparted to the surface layer portion by tensile deformation even in a case in which work hardening occurred.

Figure 13:
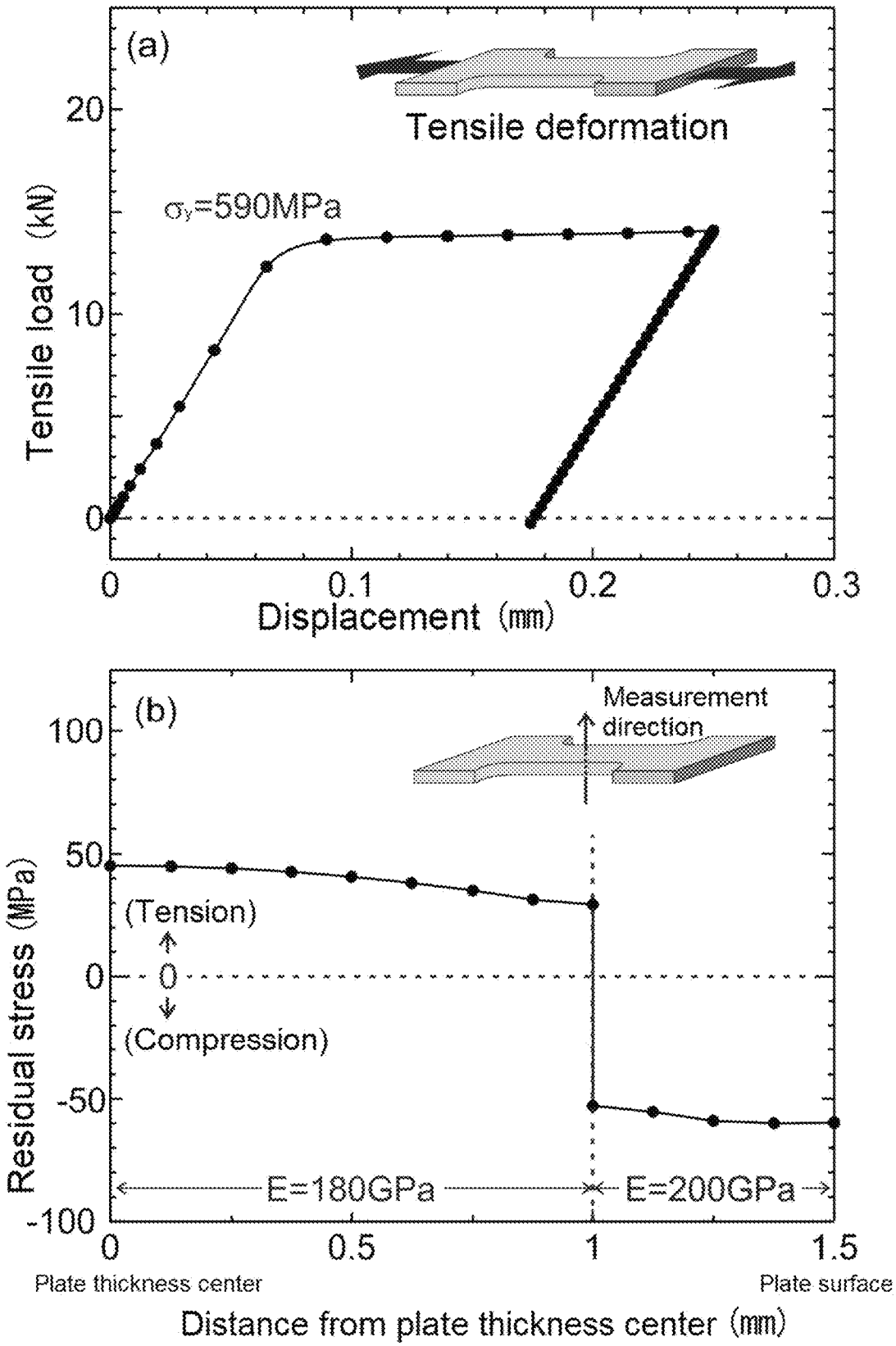
FIGS. 13(*a*) and 13(*b*) illustrate one aspect of a second embodiment of the present invention, illustrate the results obtained by finite element method (FEM) analysis, and represents a transition (a) of tensile load obtained when displacement is imparted to the analytical model in a tensile axis direction and a vertical residual stress (b) in a tensile axis direction in a plate thickness direction of the center portion of the parallel portion when the load is removed.

FIGS. 13(*a*) and 13(*b*) illustrate the results of FEM analysis. Commercially available FEM analysis software was used for analysis, and a flat tensile test piece shape having a plate thickness of 3 mm, a parallel portion plate width of 7 mm, and a parallel portion length of 10 mm was used as an analysis model. A sandwich type structure was analyzed which allocated a part having a Young's modulus of 200 GPa at the surface layer portion having a thickness of 0.5 mm in each of the regions to be one-third of the plate thickness, namely, on both of the front and back surfaces of the steel plate and a Young's modulus of 180 GPa at the plate thickness center portion which occupied a range to be two-thirds of the plate thickness. This simulates the properties in a tensile test in a case in which the tensile direction has an angle of 45 degrees from the rolling direction in the plate material which is obtained in Example 2 and has the most remarkable difference in Young's moduli at the plate thickness center portion and the surface layer portion. Moreover, the yield strength was set to 580 MPa regardless of the site, and the work hardening behavior used was the work hardening behavior obtained by a tensile test at the plate thickness center portion in a case in which the tensile direction has an angle of 45 degrees from the rolling direction in the plate material obtained in Example 2.

FIG. 13(*a*) illustrates a tensile load obtained when displacement is imparted to the analytical model in the tensile axis direction. The tensile load exhibited transition in which the increase in load after yielding became gradual. The displacement was imparted up to 0.25 and then statically decreased and the load was removed to obtain a state in which the tensile load became almost zero. The vertical residual stress in the tensile axis direction in the plate thickness direction at the center portion of the parallel portion of the test piece when being unloaded is illustrated in FIG. 13(*b*). A tensile stress of 45 MPa is generated in vicinity of the plate thickness center. The value of the tensile stress gradually decreases toward the plate surface and greatly decreases at the interface at which the values of Young's modulus are different. Moreover, a residual stress by compression is exhibited at the surface layer portion having a large Young's modulus. A compressive stress of −60 MPa is generated on the surface. From this result, it has been demonstrated that residual stress can be generated on the surface layer even when there is work hardening and stress distribution in the plate thickness direction.

Examples of the Second Embodiment

A steel plate was fabricated by the same manufacturing process as in Examples and Comparative Examples according to the first embodiment described above.

Figure 14:
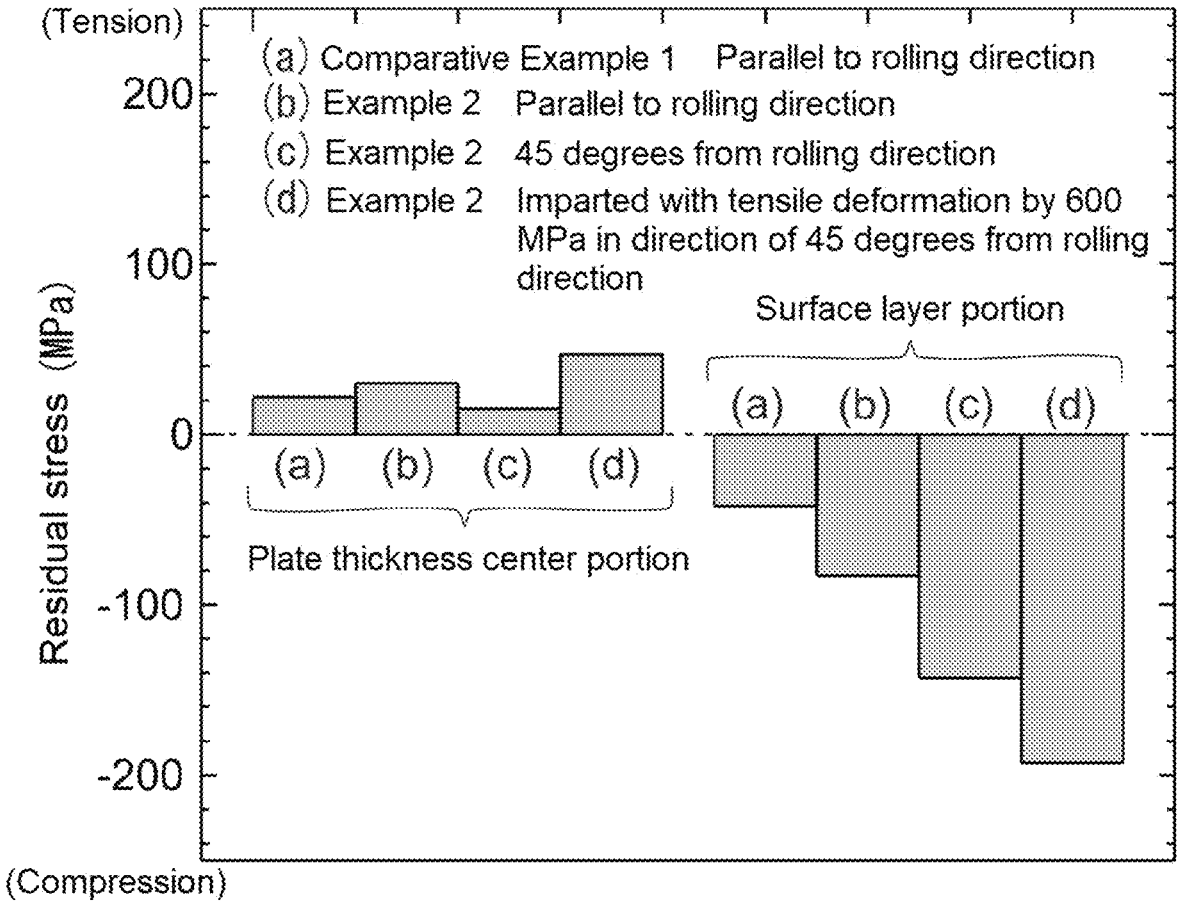
FIG. 14 illustrates one aspect of a second embodiment of the present invention and illustrates the measurement results of residual stress at the plate thickness center portion and surface layer portion of steel plates obtained in Comparative Example 1 and Example 2.

Table 3 shows the results obtained when the residual stress at the plate thickness center portion and surface layer portion of the steel plates obtained in Comparative Example 1 and Example 2 is measured. Moreover, the measurement results of residual stress are illustrated in FIG. 14. The steel plate obtained in Comparative Example 1 was subjected to the measurement of residual stress in a direction parallel to the rolling direction (item (a) in FIG. 14). The steel plate obtained in Example 2 was subjected to the measurement of residual stress in the rolling direction (item (b) in FIG. 14) and in a direction having an angle of 45 degrees from the rolling direction (item (c) in FIG. 14). Furthermore, one obtained by imparting tensile deformation to the steel plate obtained in Example 2 at room temperature in a direction of an angle of 45 degrees from the rolling direction until the deformation resistance reached 600 MPa and then removing the load from the steel plate was also subjected to the measurement of residual stress in a direction parallel to the tensile axis (item (d) in FIG. 14). As the measurement method, the calculation was performed by the $\sin^2\psi$ method using each constant described in the Standard of Stress Measurement Method by X-ray Diffraction for Steel (edited by The Society of Materials Science, Japan). The target of the X-ray source was Cr, and the tube voltage and tube current were set to 40 kV and 40 mA, respectively,

TABLE 3

| | Measured steel plate and measurement direction | Measurement result (plus: tension, minus: compression) Plate thickness center partion (MPa) | Surface layer portion (MPa) |
|---|---|---|---|
| (a) | Direction parallel to rolling direction in steel plate obtained in Comparative Example 1 | +22 | −42 |
| (b) | Direction parallel to rolling direction in steel plate obtained in Example 2 | +30 | −83 |
| (c) | Direction forming angle of 45 degrees with rolling direction in steel plate obtained in Example 2 | +15 | −143 |
| (d) | Direction forming angle of 45 degrees with rolling direction in steel plate obtained by imparting tensile plastic deformation to steel plate obtained in Example 2 in direction forming angle of 45 degrees with rolling direction and then removing load from steel plate | +47 | −193 |

At the plate thickness center portion, all the measured values indicated a tensile stress of about 50 MPa. On the other hand, a residual stress by compression is exhibited at all the surface layer portions, but the magnitude thereof varies depending on the kind of steel material. In other words, the measurement results (columns (a) and (b) of Table 3) in the direction parallel to the rolling direction in the steel plate obtained in Comparative Example 1 and the steel plate obtained in Example 2 were small values of less than 100 MPa. However, the measured value (column (c) of Table 3) in the direction forming an angle of 45 degrees with the rolling direction of the steel plate obtained in Example 2 and the measurement result (column (d) of Table 3) for the steel plate to which tensile strain was imparted in the same direction indicated large residual compressive stresses of 100 MPa or more. When the results for the as-rolled steel plate shown in column (c) of Table 3 are examined at a glance, an impression may be left that the results are an evidence of a possibility that the residual stress is obtained without imparting the tensile deformation on the contrary to the above-mentioned expectation. However, the final stage in the manufacturing process of Example 2 is plastic deformation due to warm rolling, and plastic deformation has already been introduced at the time of steel plate manufacture. Hence, the fact that the residual compressive stress is recognized at the surface layer portion even without imparting additional tensile deformation to the steel plate obtained in Example 2 can be explained by the residual stress forming mechanism already described. In other words, these measurement results of residual stress indicate that warm working using a rolling mill using a large-diameter work roll is a simple technique for achieving increases in strength and rigidity of a steel plate and for imparting a large residual compressive stress to the surface layer of the steel plate.

Moreover, from the measurement results of residual stress, it has been demonstrated that a residual stress by compression can be generated at the surface layer portion by tensile plastic deformation according to a steel plate having a larger Young's modulus at the surface layer portion than at the plate thickness center portion. In the high-rigidity and high-strength steel plates obtained by the present invention, the Young's modulus at the surface layer portion is significantly higher than that at the plate thickness center portion in the direction forming a direction of 45 degrees with the rolling direction in the steel plates obtained by all Examples and Comparative Example 2. Among these, Comparative Example 2 has low yield strength and does not have the performance as a high-strength steel plate. In addition, it is presumed based on the above-described residual stress forming mechanism that a large compressive stress is hardly formed in Comparative Example 2 even when additional tensile deformation is imparted. Hence, it can be judged that a steel plate capable of obtaining a large residual stress as presented here is obtained by the warm working process using a rolling mill using a large-diameter work roll as in Examples 1, 2, and 3 and the process according to Comparative Examples is unsuitable for the manufacture of the steel plate.

The embodiments and Examples of the present invention have been described above, but the present invention is not particularly limited to these embodiments and Examples, and various modifications can be made.

INDUSTRIAL APPLICABILITY

The steel plate exhibiting high strength and high rigidity according to the first embodiment is suitable for use as, for example, a steel plate for automobiles and a steel plate for structural materials since the steel plate has excellent strength and a large Young's modulus in a particular direction such as a rolling direction, a plate width direction, and a 45-degree oblique direction at either of a plate thickness center portion or a surface layer portion as the steel plate has a fine grain structure and different textures at the plate thickness center portion and the surface layer portion.

The structural steel plate according to the second embodiment is a steel plate having a residual compressive stress of 100 MPa or more in a direction parallel to the tensile axis in the surface layer which can be obtained by a simple technique by subjecting the high-strength and high-rigidity steel plate according to the first embodiment to tensile plastic deformation if necessary. This steel plate is suitable for use as, for example, a steel plate for automobiles and a steel plate for structural materials,

The invention claimed is:

1. A steel plate consisting of
0.05% to 0.4% by mass of C,
1.65% by mass or less of Mn,
0.55% by mass or less of Si,
0.040% by mass or less of P, and
0.30% by mass or less of S,
with the balance being Fe and inevitable impurities, wherein
an average grain size of a metallographic structure at a plate thickness center portion is in a range of 0.8 μm to 2.0 μm, an average grain size of metallographic structure at a surface layer portion is in a range of 0.3 μm to 2.0 μm, and
an estimated value of Young's modulus obtained according to the following formula at a plate thickness center portion or a surface layer portion is 210 GPa or more:

$$(\text{estimated value of Young's modulus})=f_{001}\times 132\ [\text{GPa}]+f_{111}\times 283\ [\text{GPa}]+(1-f_{001}-f_{111})\times 208\ [\text{GPa}]$$

where $f_{001}$ represents an accumulation rate of a <001> orientation with respect to a load axis, $f_{111}$ represents an accumulation rate of a <111> orientation, and $(1-f_{001}-f_{111})$ represents an accumulation rate of crystal orientations except the <001> orientation and the <111> orientation.

2. The steel plate according to claim 1, wherein the Young's modulus at the plate thickness center portion or surface layer portion is 210 GPa or more in a case in which a tensile direction in a tensile test is at least any one of a rolling direction, a plate width direction, or a direction forming an angle difference of 45 degrees from the rolling direction and the plate width direction.

3. The steel plate according to claim 1, wherein a yield strength at the plate thickness center portion or surface layer portion is 580 MPa or more.

4. The steel plate according to claim 1, wherein
an orientation accumulation rate of a texture at the plate thickness center portion is
in a range of 0% to 5% in a rolling direction, in a range of 0% to 5% in a plate width direction, and in a range of 14% to 24% in a 45-degree oblique direction in a <001> orientation and
in a range of 0% to 5% in a rolling direction, in a range of 34% to 44% in a plate width direction, and in a range of 0% to 5% in a 45-degree oblique direction in a <111> orientation, and
an orientation accumulation rate of a texture at the surface layer portion is
in a range of 20% to 30% in a rolling direction, in a range of 0% to 5% in a plate width direction, and in a range of 10% to 20% in a 45-degree oblique direction in a <001> orientation and
in a range of 16% to 26% in a rolling direction, in a range of 12% to 22% in a plate width direction, and in a range of 15% to 25% in a 45-degree oblique direction in a <111> orientation.

5. The steel plate according to claim 1, wherein
an orientation accumulation rate of a texture at the plate thickness center portion is
in a range of 0% to 5% in a rolling direction, in a range of 0% to 5% in a plate width direction, and in a range of 36% to 46% in a 45-degree oblique direction in a <001> orientation and
in a range of 0% to 5% in a rolling direction, in a range of 2% to 12% in a plate width direction, and in a range of 0% to 5% in a 45-degree oblique direction in a <111> orientation, and
an orientation accumulation rate of a texture at the surface layer portion is
in a range of 10% to 20% in a rolling direction, in a range of 10% to 20% in a plate width direction, and in a range of 14% to 24% in a 45-degree oblique direction in a <001> orientation and
in a range of 8% to 18% in a rolling direction, in a range of 28% to 38% in a plate width direction, and in a range of 5% to 15% in a 45-degree oblique direction in a <111> orientation.

6. The steel plate according to claim 1, wherein
an orientation accumulation rate of a texture at the plate thickness center portion is
in a range of 0% to 5% in a rolling direction, in a range of 0% to 5% in a plate width direction, and in a range of 12% to 22% in a 45-degree oblique direction in a <001> orientation and
in a range of 0% to 5% in a rolling direction, in a range of 20% to 30% in a plate width direction, and in a range of 0% to 5% in a 45-degree oblique direction in a <111> orientation, and an orientation accumulation rate of a texture at the surface layer portion is in a range of 0% to 5% in a rolling direction, in a range of 0% to 5% in a plate width direction, and in a range of 8% to 18% in a 45-degree oblique direction in a <001> orientation and in a range of 2% to 12% in a rolling direction, in a range of 10% to 20% in a plate width direction, and in a range of 2% to 12% in a 45-degree oblique direction in a <111> orientation.

7. The steel plate according to claim 1, wherein a difference in Young's moduli at the plate thickness center portion and the surface layer portion is 5 GPa or more.

8. A method for manufacturing the steel plate according to claim 1, the method comprising performing rolling of a steel plate or steel material at a temperature in a range of 400° C. or more and 600° C. or less using a rolling mill having a work roll diameter of 650 mm or more, the steel plate or steel material consisting of 0.05% to 0.4% by mass of C, 1.65% by mass or less of Mn, 0.55% by mass or less of Si, 0.040% by mass or less of P, and 0.30% by mass or less of S, with the balance being Fe and inevitable impurities.

9. The method according to claim 8, wherein the rolling is any of reverse rolling, cross rolling, or one-way rolling of the steel plate or steel material.

10. A structural steel plate comprising the steel plate according to claim 1, wherein a residual compressive stress in a surface layer is 100 MPa or more.

11. The method according to claim 8, the method further comprising imparting tensile plastic deformation to the steel plate after the rolling to obtain a structural steel plate.

12. The method according to claim 8, the method further comprising performing plastic working after the rolling to obtain a structural steel plate.

* * * * *